US006722101B2

(12) United States Patent
Hartness et al.

(10) Patent No.: US 6,722,101 B2
(45) Date of Patent: Apr. 20, 2004

(54) CONTINUOUS CIRCULAR MOTION CASE PACKING AND CLOSURE APPARATUS AND METHOD

(75) Inventors: Thomas Patterson Hartness, Greenville, SC (US); Richard M. Wiernicki, Roebuck, SC (US); Robert Leslie Dillard, Easley, SC (US); David Lee Scott, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 0 days.

(21) Appl. No.: 10/232,550

(22) Filed: Aug. 29, 2002

(65) Prior Publication Data

US 2003/0009994 A1 Jan. 16, 2003

Related U.S. Application Data

(63) Continuation of application No. 10/223,398, filed on Aug. 19, 2002, which is a continuation-in-part of application No. 09/418,619, filed on Oct. 15, 1999, which is a continuation-in-part of application No. 09/301,394, filed on Apr. 28, 1999, now Pat. No. 6,571,532, which is a continuation-in-part of application No. 09/137,327, filed on Aug. 20, 1998, now abandoned, which is a continuation-in-part of application No. 08/736,376, filed on Oct. 24, 1996, now Pat. No. 5,797,249, which is a continuation-in-part of application No. 08/338,026, filed on Nov. 10, 1994, now Pat. No. 5,588,282.

(51) Int. Cl.[7] ..... B65B 5/00

(52) U.S. Cl. ..... 53/247; 53/251; 53/539; 53/376.3; 53/376.4; 53/377.4

(58) Field of Search ..... 53/247, 249, 248, 53/250, 251, 473, 495, 496, 497, 539, 376.5, 377.4, 376.4, 376.3, 534, 543, 260

(56) References Cited

U.S. PATENT DOCUMENTS

| | | | |
|---|---|---|---|
| 1,481,259 A | 1/1924 | Harrison | |
| 1,538,406 A | 5/1925 | McCarty et al. | |
| 1,583,767 A | 5/1926 | Akins et al. | |
| 1,958,846 A | 5/1934 | Christensen | |
| 2,277,688 A | 3/1942 | Cattonar et al. | |
| 2,350,692 A | 6/1944 | Milek | |
| 2,730,279 A | 1/1956 | Enock | |

(List continued on next page.)

FOREIGN PATENT DOCUMENTS

| | | | |
|---|---|---|---|
| DE | 3431066 A1 * | 3/1986 | ..... B65B/21/18 |
| DE | 4216721 A1 | 11/1993 | |

*Primary Examiner*—John Sipos
*Assistant Examiner*—Louis Huynh
(74) *Attorney, Agent, or Firm*—McNair Law Firm, P.A.; Cort Flint

(57) ABSTRACT

A packing apparatus which includes a feed conveyor adapted to convey articles to a pick up station and a case conveyor adapted to sequentially convey cases, having an open top and a plurality of flaps, to a feed station. Pick up and grid heads are provided and are adapted to pick up successive slugs of the articles at the pick up station and to sequentially deposit the slugs in each of the cases while they are in the release station. A removal conveyor is provided to successively receive the slug filled cases from the release station and pass them onto a case sealing apparatus which is arranged over the removal conveyor and is operative to apply an adhesive to certain of the flaps and to then move the flaps over the open top into a secured closed position.

19 Claims, 19 Drawing Sheets

U.S. PATENT DOCUMENTS

| | | | | | |
|---|---|---|---|---|---|
| 2,760,316 | A | | 8/1956 | Okulitch et al. | |
| 2,807,125 | A | | 9/1957 | George | |
| 2,860,763 | A | | 11/1958 | Kohrs et al. | |
| 3,012,811 | A | | 12/1961 | Sandrock | |
| 3,327,450 | A | | 6/1967 | Carter | |
| 3,410,050 | A | | 11/1968 | Bell | |
| 3,505,787 | A | | 4/1970 | Tiews | |
| 3,553,927 | A | | 1/1971 | Anglade, Jr. | |
| 3,553,932 | A | | 1/1971 | Rowekamp | |
| 3,555,770 | A | | 1/1971 | Rowekamp | |
| 3,555,773 | A | | 1/1971 | Rowekamp | |
| 3,648,427 | A | | 3/1972 | Raudat et al. | |
| 3,727,366 | A | | 4/1973 | Schueter | |
| 3,780,492 | A | | 12/1973 | Corderoy | |
| 3,805,476 | A | | 4/1974 | Kawamura et al. | |
| 3,971,190 | A | | 7/1976 | McGill | |
| 4,055,943 | A | | 11/1977 | Reichert | |
| 4,215,521 | A | | 8/1980 | Hartness | |
| 4,294,057 | A | | 10/1981 | Winiasz | |
| 4,300,330 | A | | 11/1981 | Hartness | |
| 4,446,672 | A | | 5/1984 | Raudat | |
| 4,457,121 | A | | 7/1984 | Johnson et al. | |
| 4,541,524 | A | | 9/1985 | McGill et al. | |
| 4,587,792 | A | | 5/1986 | Hartness et al. | |
| 4,723,649 | A | | 2/1988 | Hartness et al. | |
| 4,891,928 | A | * | 1/1990 | James et al. | 53/250 |
| 5,212,930 | A | * | 5/1993 | Raudat | 53/263 |
| 5,257,888 | A | * | 11/1993 | Kronseder | 414/416.06 |
| 5,313,764 | A | | 5/1994 | Kronseder | |
| 5,375,395 | A | * | 12/1994 | Gmeiner | 53/493 |
| 5,379,573 | A | * | 1/1995 | Greenwell | 53/491 |
| 5,394,673 | A | * | 3/1995 | Hartness | 53/248 |
| 5,426,920 | A | * | 6/1995 | Quadalti | 53/564 |
| 5,487,257 | A | * | 1/1996 | Domeier et al. | 53/539 |
| 5,501,064 | A | | 3/1996 | Ingram et al. | |
| 5,555,709 | A | | 9/1996 | Savigny et al. | |
| 5,588,282 | A | * | 12/1996 | Hartness | 53/473 |
| 5,595,043 | A | * | 1/1997 | Radigan | 53/201 |
| 5,797,249 | A | | 8/1998 | Hartness | |
| 6,571,532 | B1 | | 6/2003 | Wiernicki et al. | |

* cited by examiner

CONTINUOUS CIRCULAR MOTION CASE PACKING AND CLOSURE APPARATUS AND METHOD

This is a continuation of co-pending U.S. patent application Ser. No. 10/223,398, filed on Aug. 19, 2002, which is a continuation-in-part of a co-pending U.S. patent application Ser. No. 09/418,619, filed on Oct. 15, 1999 entitled CONTINUOUS CIRCULAR MOTION CASE PACKING AND DEPACKING APPARATUS AND METHOD, which is a continuation-in-part of U.S. patent application Ser. No. 09/301,394, filed Apr. 28, 1999, now U.S. Pat. No. 6,571,532 entitled Continuous Motion Case Packing Apparatus And Method; which is a continuation-in-part of U.S. patent application Ser. No. 09/137,327, filed Aug. 20, 1998, entitled Continuous Motion Case Packing Apparatus, now abandoned; which is a continuation of U.S. patent application Ser. No. 08/736,376, filed on Oct. 24, 1996, entitled Continuous Motion Case Packing Apparatus, which is now U.S. Pat. No. 5,797,249 issued on Aug. 25, 1998; which is a continuation-in-part of U.S. patent application Ser. No. 08/338,026, filed on Nov. 10, 1994, entitled Continuous Motion Case Packing Apparatus, which is now U.S. Pat. No. 5,588,282 issued on Dec. 31, 1996; and the above applications and patent disclosures are incorporated herein by reference.

BACKGROUND OF THE INVENTION

The invention relates to an apparatus and method for transferring articles into and out of cases using continuous motion, and particularly, where the continuous motion is basically circular and at higher transfer speeds with a small footprint.

In the art of case packing, large numbers of articles must be grouped and packaged rapidly by an apparatus that will function dependably without damage to the articles processed. When unpacking articles from cases, the articles are already grouped in a pattern in the case reducing some of the problems of article pick up. Case packing apparatus has been generally categorized as either intermittent case packing or continuous case packing. In intermittent case packing the article flow and/or case flow is interrupted during article pick up and/or release. Most recently, attention has been directed to continuous case packing in order to increase production. However, the continuous case packing has brought increased problems with handling the processed articles without breakage, damage, or interruption.

In the continuous case packing apparatus, articles are grouped together in successive slugs at a pick up position. The slugs are typically picked up at the pick up position by article grippers carried by an orbital handling machine rotating about two vertical axes. The slugs are transferred to a case loading position where the grippers release the slug of articles into a case. The articles can be released either simultaneously or sequentially as the case is conveyed beneath the slug of articles. Apparatus of this type may be either of the "drop packer" type or "placement packer type." In the drop packer type, the articles are allowed to drop at least a small distance into the case after release. In the placement packer type, the drop, if any, is minimal and the articles are essentially placed gently onto the bottom of the case.

Continuous motion machines rotating about a single horizontal axis are shown in U.S. Pat. Nos. 5,375,395, 5,257,888, and 5,313,764 using articulating arms and pickup heads. A set of article grippers is carried on the ends of the articulating arms. However, during the angular descent from the pick up position to the case packing position, both horizontal and vertical accelerations are typically encountered by the articles which are gripped only at their tops or necks. Intermittent circular machines rotating about a single vertical axis are shown in U.S. Pat. Nos. 3,780,492 and 2,807,125.

Various other case packers, generally of the continuous motion type, using a vertical orbital conveyor are shown in U.S. Pat. Nos. 5,212,930; 4,541,524; and 4,294,057. The first patent shows depositing the articles sequentially and individually, rather than as a group or slug, into partitioned cases without positively gripping the articles. The latter two patents use gripper devices to grip and place the articles. U.S. Pat. No. 4,457,121 discloses a continuous motion bottle packer wherein a plurality of grids are mounted individually on spokes of a vertical wheel so that each grid moves through an article in feed position where groups of articles are fed into the grid without interrupting the forward speed. Angular and horizontal accelerations of the articles and their contents are encountered due to the rotary wheel motion during the transfer which may be detrimental to the article and/or contents.

Continuous case packers are also known in which a horizontal rotary carousel is used to move vertically reciprocating gripper sets in a horizontal plane about two vertical axes. The reciprocating gripper sets pick up a slug of articles at one position and transfer the slug of articles to a second position where the gripper set is lowered to deposit the articles into a case. Typically the pickup and release stations are on opposite sides of the carousel, requiring parallel conveyors on each side. However, the disposition of the rotary carousel in a horizontal plane requires an inconvenient floor layout, which also occupies a large amount of floor space. The parallel conveyor arrangements needed for the in feed and out feed of articles adds to the floor space problem. The path of the gripper sets between the slug pick up position and the case packing position is also typically curved producing angular and acceleration forces on the articles. The curved article transfer path intersects the path of the conveyed case only for a brief interval making timing a factor. In various of the rotary carousel types, it is known to deposit the articles by lowering the articles, already gripped by the gripper set, through resilient fingers that guide the articles into partitioned cases.

Case packers, generally of the intermittent type, are shown in U.S. Pat. Nos. 3,553,932 and 3,505,787 which also disclose using combinations of a lifting head having suction cups and bottle grids having pockets for picking up containers and depositing them into cases. The containers and the cases are conveyed on parallel conveyors rather than in-line conveyors, and the transfer from the pick up position to the case loading position is lateral, or transverse, to the flow of containers and cases. U.S. Pat. No. 2,277,688 discloses another case packer using an arrangement of a gripper set and a bottle guide set to package the containers into a case. These type of case packers are generally non-continuous as compared to the continuous motion in-line transfer case packers described above where neither the flow of articles nor the flow of the cases is interrupted during operation of the packer.

Accordingly, an object of the invention is to provide an improved continuous case packing and depacking apparatus having a characteristic circular motion.

Another object of the invention is to provide a continuous motion apparatus and method which moves in a circular motion to provide high speeds of operation.

Another object of the invention is to provide a continuous, circular motion case packing or depacking apparatus and method which rotates about a single axis to provide a small footprint and high speed operation.

Another object of the invention is to provide a continuous, circular motion case packing apparatus and method in which slugs or groups of articles are picked up and transferred to a release station where the motion of the pickup heads is converted to a substantially straight-line motion along a pick up section during which time the articles are picked up.

Still another object of the invention is to provide a continuous, circular motion case packing or depacking apparatus and method wherein the articles are either picked up or released over a circular plate disposed below the path of the pickup heads and rotating about the same axis.

Yet another object of the invention is to provide a continuous motion apparatus and method in which a revolving turret moves a plurality of transfer arms and a transfer plate in a circular path about a single vertical axis as reciprocating article pickup heads and grid heads, carried by the transfer arms, pick up and release the articles wherein either the pick up or release occurs over a circular plate disposed below the pickup heads moving in a circular motion for high speed, reliable operation.

Still another object of the invention is to provide a packing apparatus with a continuous motion circular plate which moves through a case pick up position, an article pick up position, an article deposit position and a case removal position.

Still another object of the invention is to provide a continuous motion packing apparatus which includes a plurality of conveyor belts separated by a rotating plate.

Yet another object of the invention is to provide a continuous motion apparatus and method in which a revolving plate moves successive filled cases onto a sealing section where each case is closed and sealed.

Yet another object of the invention is the provision of a continuous operation of packing articles into cases, removing the packed cases onto a closure section where the case flaps are moved into sealed positions.

SUMMARY OF THE INVENTION

The invention is directed to a packer which includes a delivery for moving articles into a pick up position and a take-away for removing cases filled with the articles. A plate is located between the delivery and the take-away and is arranged to rotate about a single axis. The plate is operative to move sequentially the cases into a deposit or release position for receiving the article from the pick up position and to move the cases to the take-away. A rotating tower which carries the plate is supported by a frame member.

Pickup and grid heads are carried by the tower for movement about the axis and for relative vertical movement. A cam is carried by the frame and is operative to control pickup and grid heads through their relative vertical movements.

A third delivery is provided for moving the case to a dispensing position. The third delivery includes a rotating belt and a dispenser. The belt is operative to move the cases to the dispensing position where they are held and released in timed sequence onto the rotating plate. A plurality of radially spaced pins secured with the upper surface of the plate engage and circumferentially locate the cases on the plate. The tower includes a support frame which acts to support the plate. An adjusting member which is carried by the tower is provided for adjusting the plate circumferentially relative to the support frame and pickup and grid heads. Preferably the adjusting member is a rack and pinion arrangement.

Arcuate inner and outer guide rails are positioned above and adjacent the edges of the plate. The guide rails are operative to engage and individually position each case radially on the plate during movement toward and through the deposit position. The guide rails are adjustably mounted with the frame. Adjustment of the guide rails allows the apparatus to accommodate different case sizes.

An apparatus for transferring articles which includes a frame which supports a tower for rotation about a single axis. The tower carries a plurality of paired grid and pickup heads for vertical and rotational movement between a pick up and a release or deposit position. A circular plate is carried by the tower for movement about the tower and through the deposit position.

A first conveyor is provided for moving articles into a pick up position adjacent the plate in the form of article slugs. A second conveyor is provided for moving the cases sequentially onto the plate.

The paired grid and pickup heads are controlled to move onto and to the pick up of a slug of the articles when moving through the pick up position to then move to the deposit position to deposit the slug of articles into a case when both the case and the pickup and guide grids are moving through the deposit or release position.

A third conveyor is provided to receive and remove the filled cases away from the plate.

A plurality of positioning pins carried by the plate in spaced circumferential positions and radially spaced from the axis. The pins are adapted to circumferentially position the cases during movement on the plate. An adjusting member is provided for circumferentially adjusting the positioning pins relative to the pickup and grid heads.

Inner and outer guide rails are provided and are carried by the frame in radially spaced positions above the plate. Adjustable mounting members secure the guide rails in radially adjustable positions.

A packer apparatus comprising a frame carrying a rotating plate which is adapted to receive successive cases. Each of the cases includes front, rear and side flaps which are in folded position adjacent vertical sides of the case. The plate moves the cases through a deposit position and a removal position.

Pickup and grid heads which are carried by the frame are moved along vertical and circular paths between a lower position to deposit or release a slug of articles into each case as it passes through the deposit ore release position. The apparatus includes flap separators which are carried by the frame and are operative to move to separate and lift the flaps of the case during movement of the pickup and grid heads vertically away from the lower release position.

Positioning members are provided to fold down and hold the front and rear flaps from their lifted position as the filled cases are moved from the deposit position and into a take-away or removal position.

The separators are pivotally mounted with the grid head. A control mechanism which is carried by the pickup and grid heads is operative to locate each separator in selective positions relative to the vertical sides of the case during movement of the pickup and grid heads which allows the separators to first separate the flaps and secondly to elevate the front and rear flaps. The control mechanism comprises a cam carried by the pickup head and a spring carried by the grid head.

The positioning members include a positioning rail arranged adjacent the removal position which acts to fold said front flap down. The positioning members also include a rotating positioning disk which is operative to engage and fold down the rear flap as the carton moves through the removal position.

Case sealing apparatus is located over the removal conveyor adjacent the removal position. The sealing apparatus includes guide and support rails which are arranged adjacent the removal conveyor. The guide and support rails include a support zone and a positioning zone. The sealing apparatus also includes adhesive applicators which apply adhesive onto the side flaps as they are supported by the guide and support rails in the support zone. The guide and support rails are operative to elevate the side flaps of the case in the positioning zone. The case sealing apparatus includes side flaps depressing arms which engage the elevated side flaps leaving the positioning zone and urge them into a closed position. The case sealing apparatus also includes a press zone which is located over the removal conveyor adjacent the positioning zone, the sealing apparatus acts to press and hold down the side flaps in position against the front and rear flaps until the adhesive secures them in position. The sealing apparatus is preferably an, elongated flexible weight.

The invention further includes the method of moving pickup and grid heads in an article handling machine to include the steps of providing a pickup station and continuously moving articles into the pickup station; providing a circular plate and rotating the plate about an axis; rotating said pickup and grid heads in a circular path about the axis, through the pickup station and causing the pickup heads to also move in a generally straight line during rotational movement through the pickup station.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
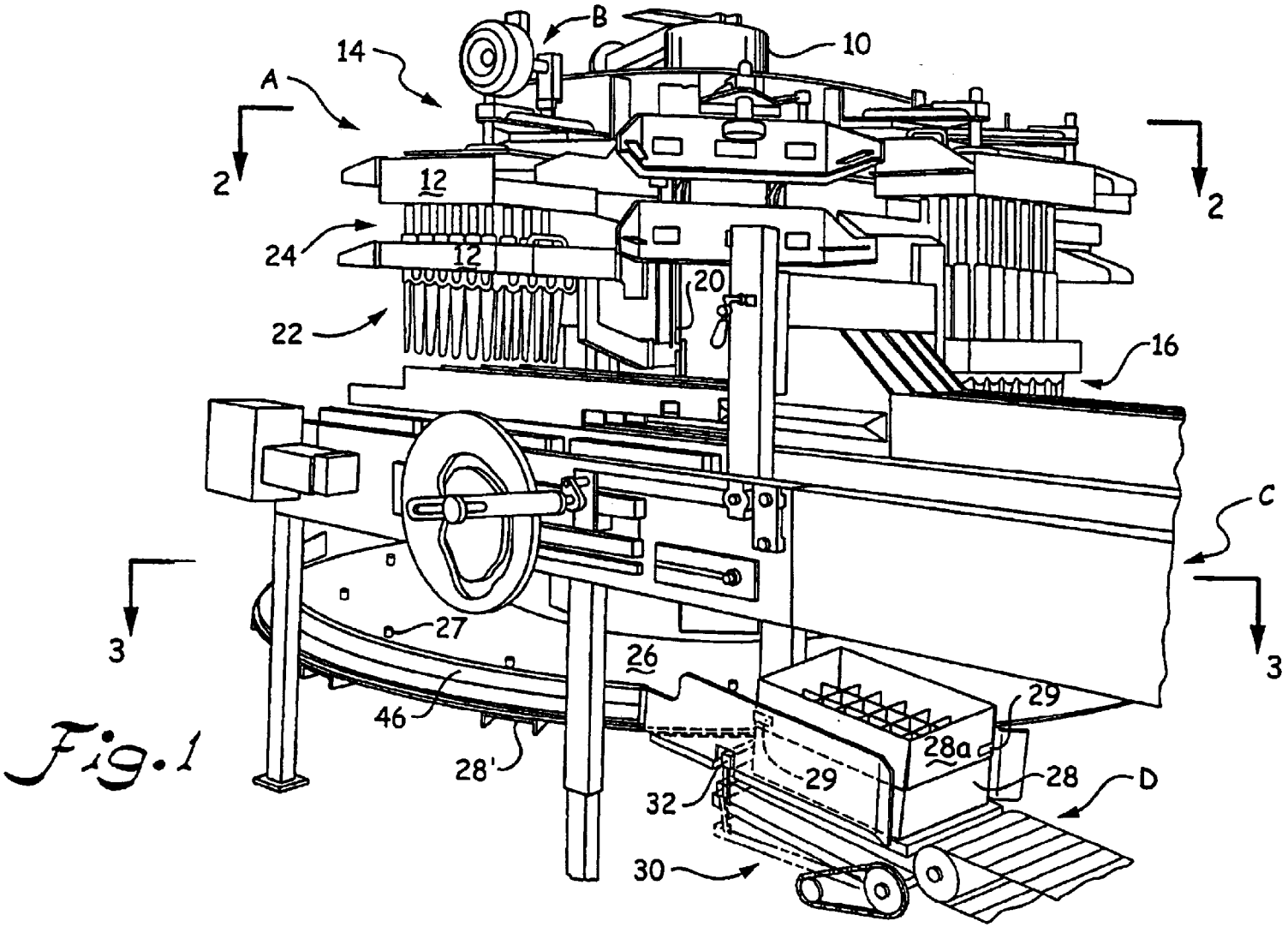
FIG. 1 is a perspective view of a circular, continuous motion packing and depacking apparatus.
Figure 2:
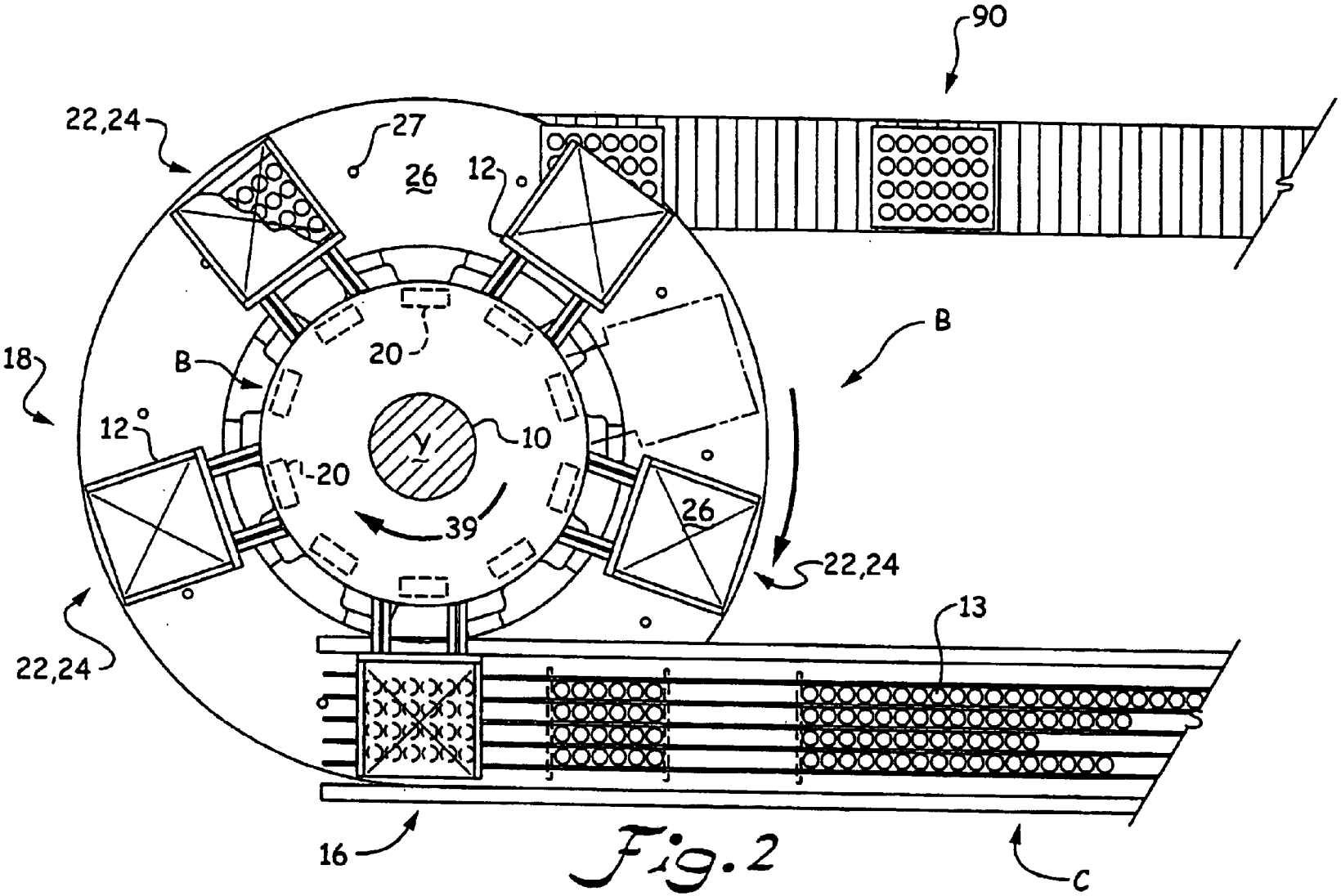
FIG. 2 is a top plan sectional view of the apparatus of FIG. 1 taken generally along line 2—2.
Figure 3:
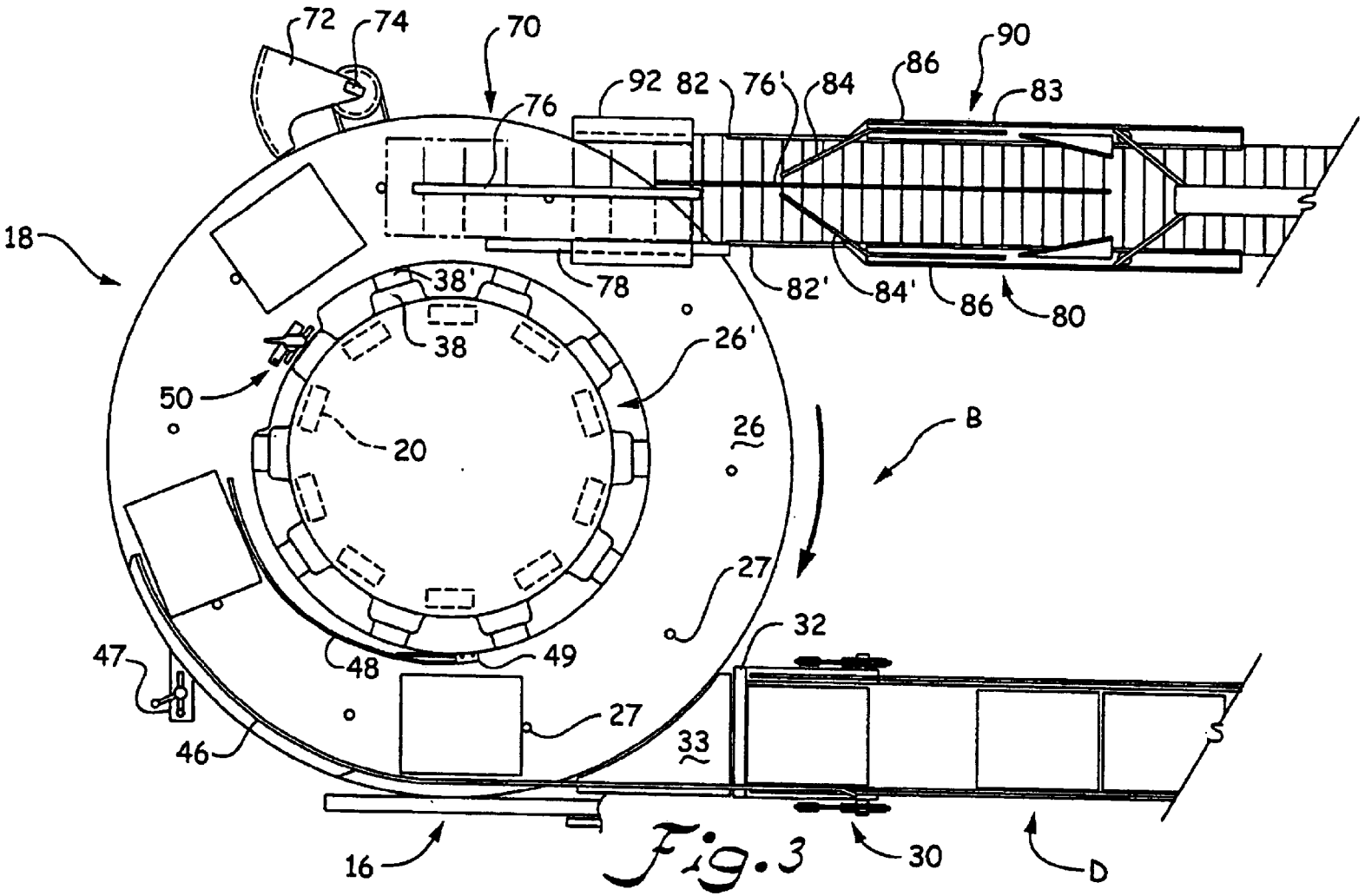
FIG. 3 is a top plan sectional view similar to FIG. 2 showing case feeding, removing and closing apparatus.

Referring now to the drawings, the invention will be described in more detail. As can best be seen in FIG. 1, apparatus and method for packing articles into cases, or depacking articles from cases, in a simple, continuous circular motion, is illustrated generally as A. The apparatus includes a rotating turret B which rotates about a single vertical axis Y, and a stationary central column 10. A plurality of article transfer arms 20 are carried by the rotating turret, as can best be seen in FIGS. 2 and 5E. A plurality of reciprocating grid heads 22 and article pick up heads 24, are carried on the transfer arms by way of support frames 12. The pickup and grid heads themselves may be of conventional construction to form no part of the instant invention. They, therefore, will not be further described. FIGS. 1, 2 and 3 illustrate the embodiment of the invention in the form of a case packing apparatus and method in which articles are packed into cases. In the illustrated embodiment, the pickup and grid heads are slidably carried on the transfer arms and reciprocate in a linear motion for picking up the articles at a pickup station, designated generally as 16. The invention can also be utilized in the form of a case depacking apparatus and method wherein the articles are removed from cases. Presently, and because the inventive aspects of the pickup and deposit motions are generally the same whether the machine is used for packing or depacking, the invention will be described in relation to the case packing embodiment of the apparatus and method shown in FIGS. 1 and 2.

An article feeder, designated generally as C, is illustrated for conveying articles 13 to pick up station 16. Article feeder C may be a slug feeder having a metering section, as disclosed in U.S. Pat. No. 5,797,249 ("the '249 patent"), incorporated herein by reference. The slug metering section receives a continuous flow of articles 13 which are conveyed from a laner section. The metering section breaks the articles up into a desired number of articles having a pattern which corresponds to the pattern of the case into which the articles are to be packed. The articles are picked up at pickup station 16 and deposited into empty cases 28 at a release or deposit station, designated generally as 18, which constitutes a case packing station in the embodiment of FIGS. 1 and 2. For this purpose, a case indexing conveyor, designated generally as D, is disposed below slug feeder C to provide a continuous flow of indexed cases 28 to release station 18 where the articles are generally deposited in the case. The case conveyor includes a dispensing section for sequentially moving the cases onto plate 26. Pins 27 act to position for movement the indexed cases about turret B with plate 26. Dispensing section 30 includes bar 32 which is operated in sequence with shaft 10 to release in timed sequence cases 28 onto plate 26 which in turn moves the case to release or deposit station 18. The configuration of the plate is circular. When used as a case depacker, the article feeder constitutes an indexing case conveyor which conveys indexed cases of empty articles for removal.

Figure 5A:
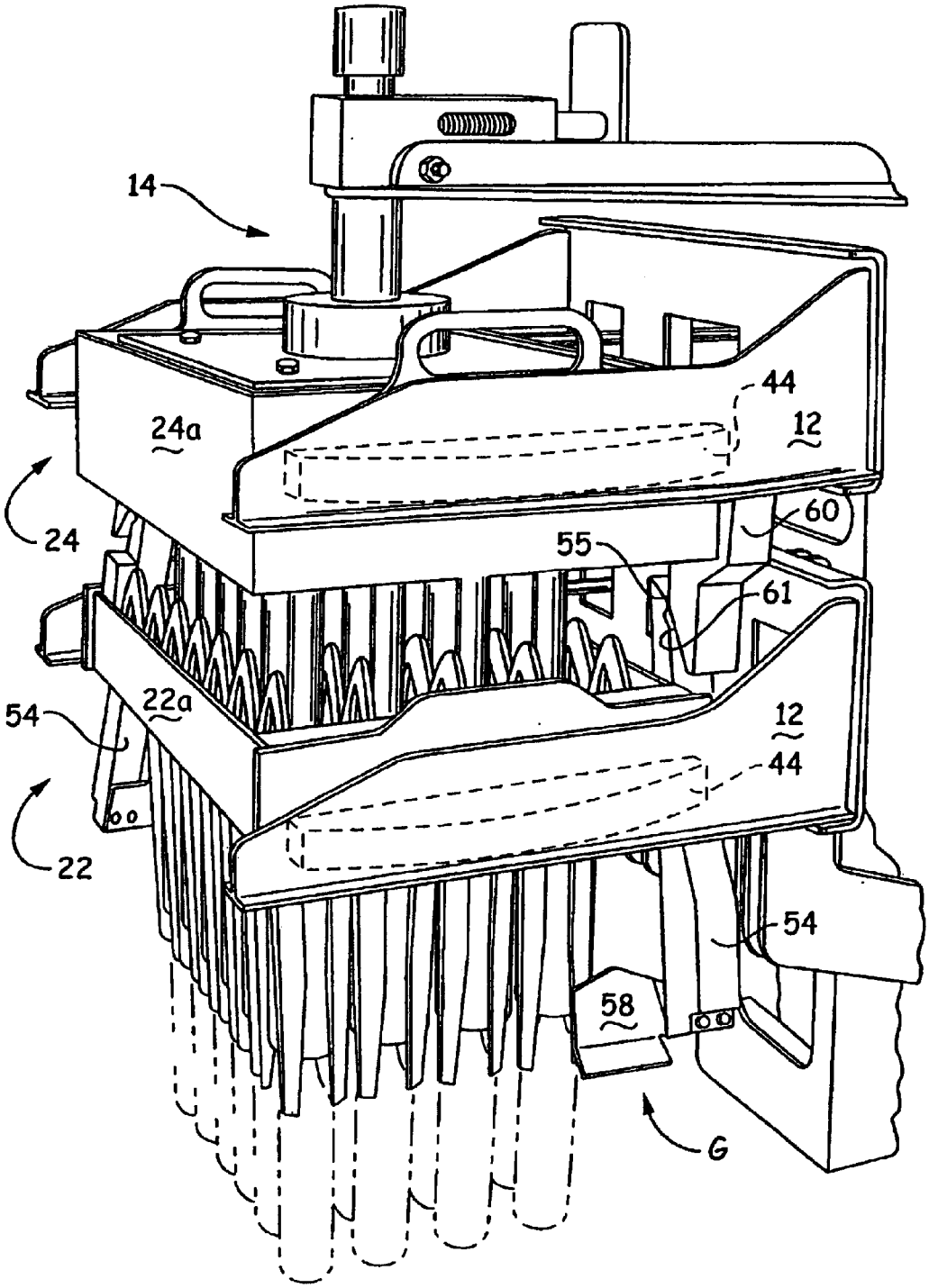
FIG. 5A is a perspective view of a pickup head support and actuator mechanism.
Figure 5B:
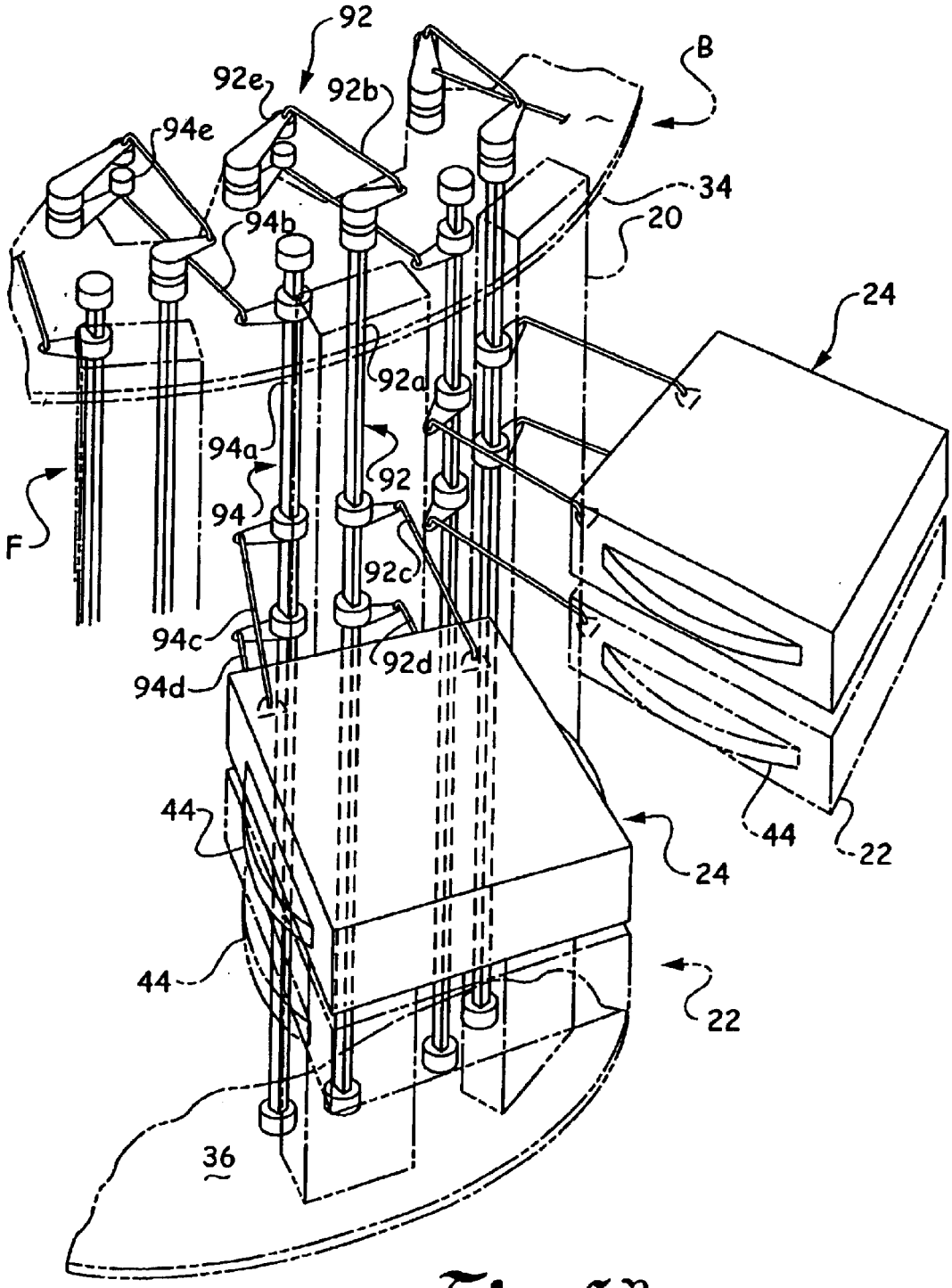
FIG. 5B is a perspective view illustrating the translatory drive for the pickup and grid heads which controls the oscillating motion of the heads over the pick up section allowing the straight line motion of the heads.
Figure 5C:
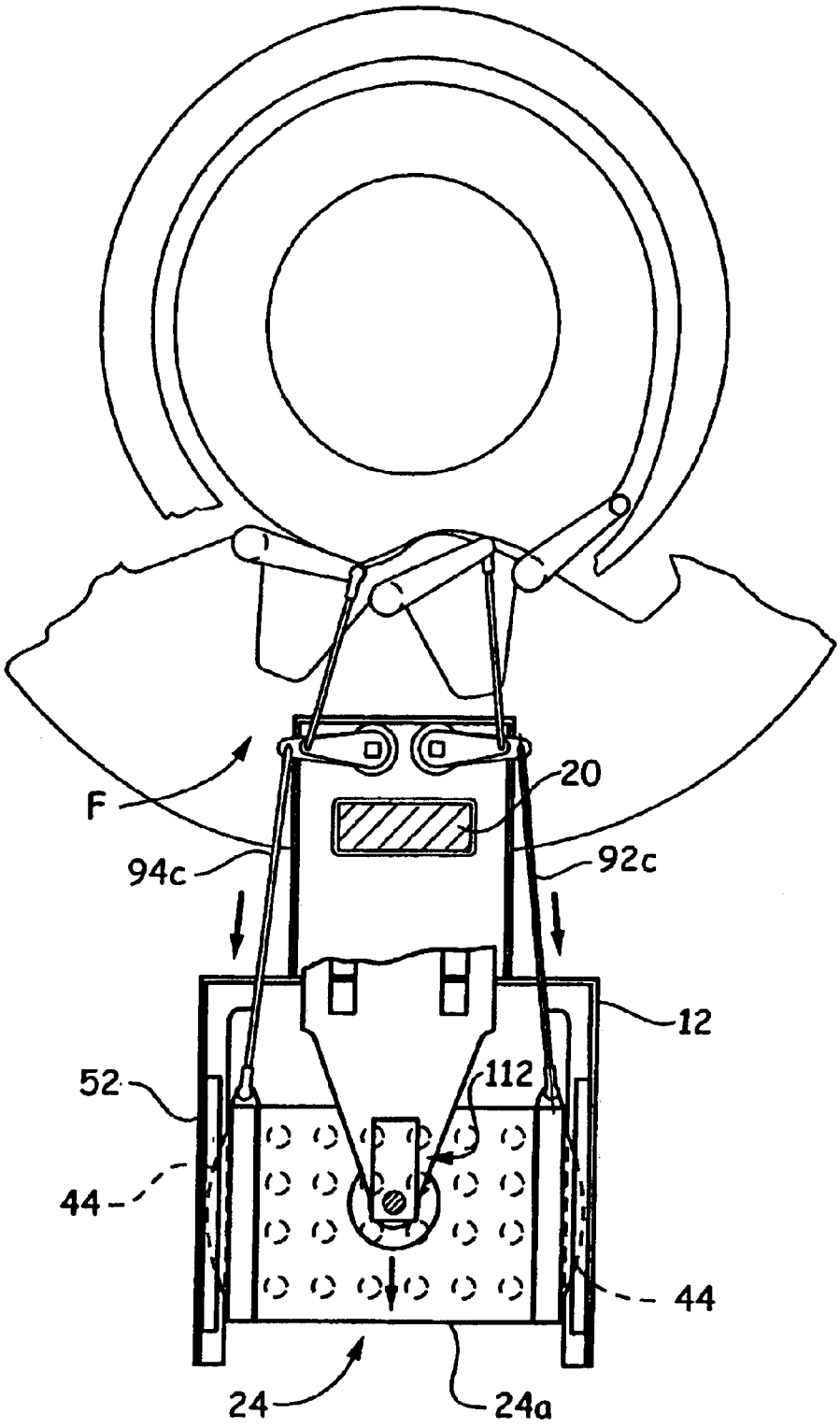
FIG. 5C is a top plan view illustrating the translatory drive for the pick up section.
Figure 5D:
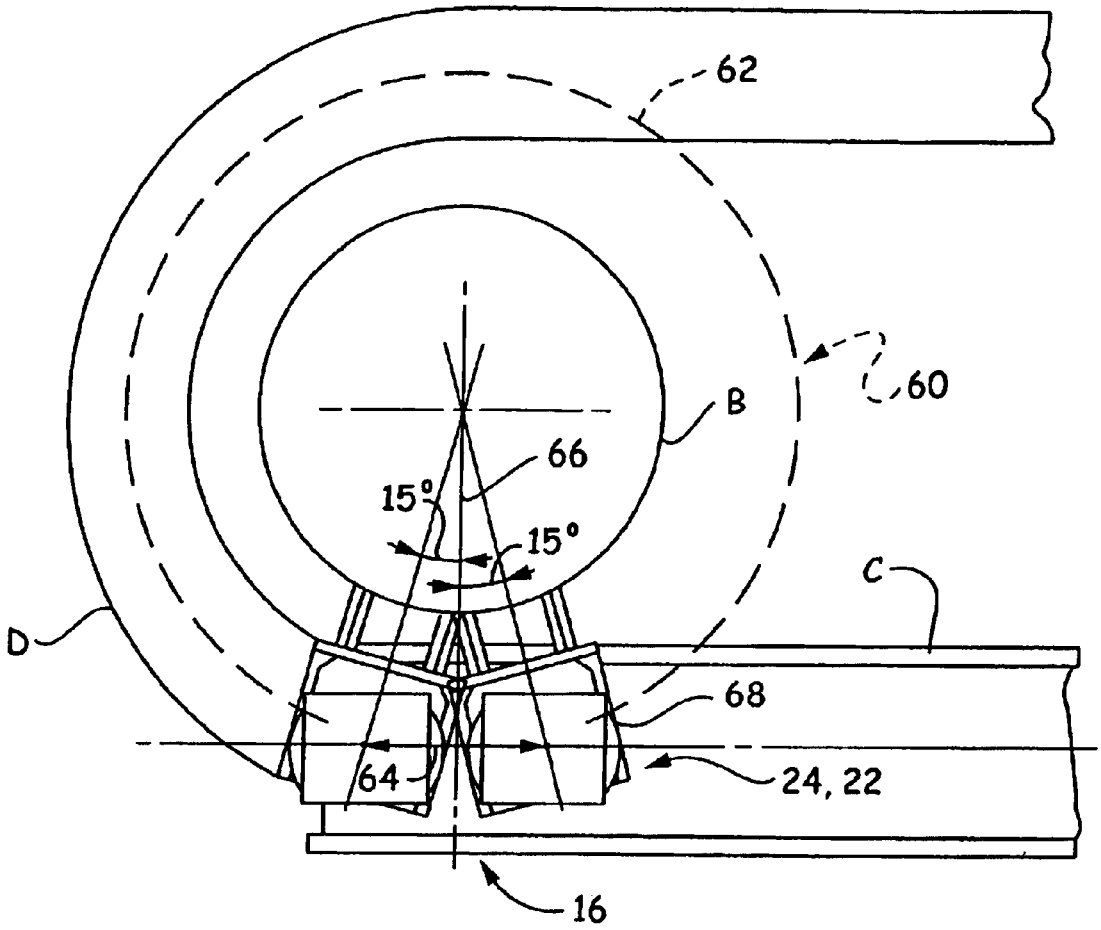
FIG. 5D is a schematic view illustrating a closed cycle path of the pickup and grid heads wherein their circular motion is compounded to include a straight line motion.
Figure 5E:
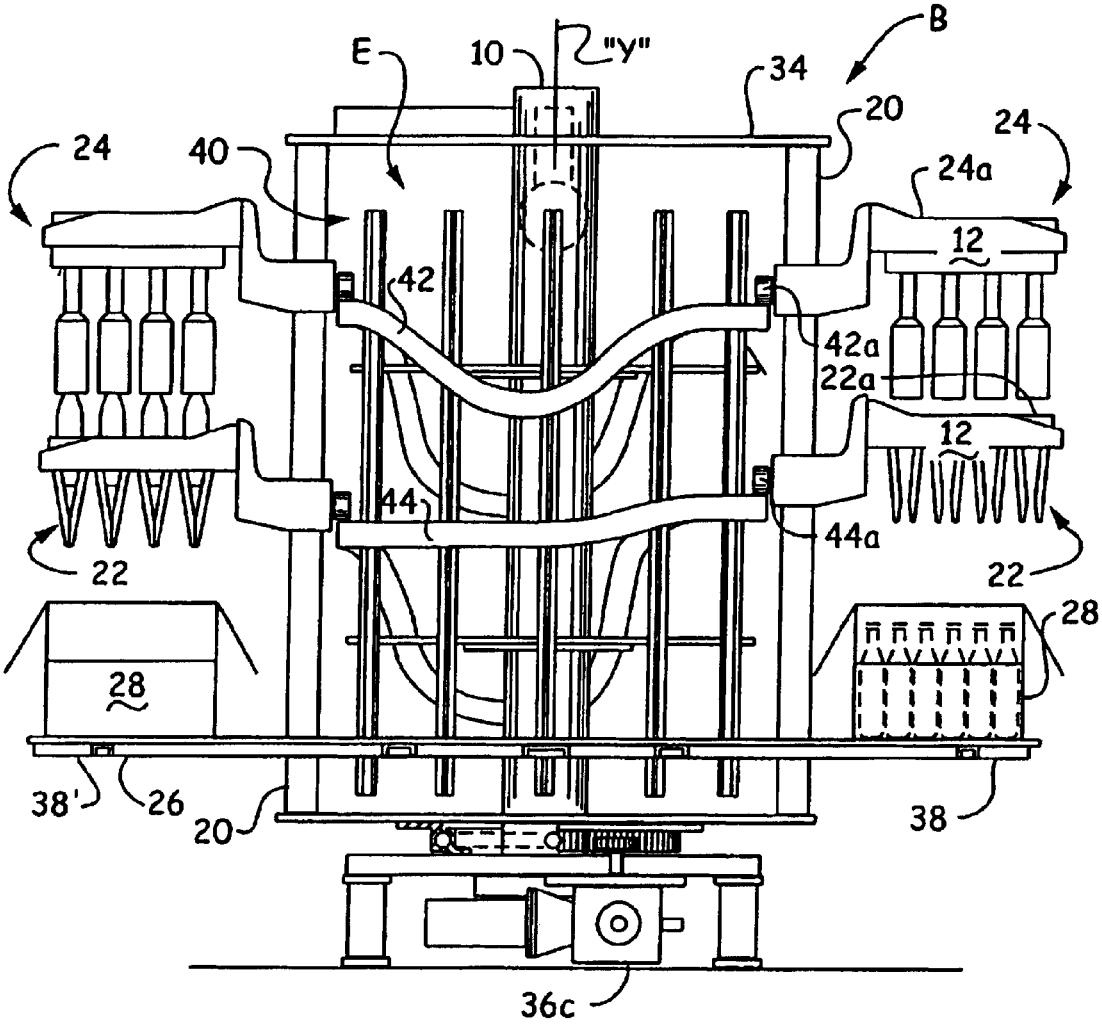
FIG. 5E is a simplified side elevational view illustrating the circular turret, the head support frames and the circular cam tracks for controlling the vertical movement of the pickup and grid heads.

As can best be seen in FIG. 5E, turret B includes a top frame member 34 and bottom frame member 36 between which transfer arms 20 are affixed. Transfer arms 20, in the illustrated form of steel beams, are circumferentially spaced around the frame members to generally define the turret B which rotates in circular path 39 (FIG. 2). As illustrated, there are ten transfer arms spaced around the turret. The number of arms may vary depending on the application. Turret B is constructed and driven in the manner described in detail in co-pending U.S. patent application Ser. No. 09/418,619 afore referred to. Turret B is rotated clockwise as illustrated. The turret may be also be rotated counter clockwise if the apparatus is designed that way. A gear motor may be utilized to drive case conveyor D through a suitable belt drive arrangement, so that the turret and transfer operation are synchronized with the conveying of indexed cases to be packed or depacked.

Within the interior of turret B, as defined by the turret cage of transfer arms 20, is stationary central column or support 40 supported by the column 10. Affixed to stationary support 40 is a cam support drum having a plurality of vertical braces which are affixed to the stationary support 40 in suitable manner. Central column 10 extends through a clearance hole formed in top and bottom turret plates 34, 36. Circular cams 42, 44 encircle and are affixed to the braces and form part of a vertical position mechanism E that controls the vertical positions of pickup and grid heads 24, 22. The drum braces, cams, intermediate plates, and central column may be affixed together in any suitable manner, such as conventional bolts, to define a stationary structure about which turret B rotates. Other suitable means of reinforcing and securing the operative construction together may be utilized, such as welding and the like, as will be apparent to a mechanic of average skill in the art.

Vertical motion mechanism E preferably includes circular cams 42 and 44 carried to control the positions of pickup heads 24 and grid heads 22, as can best be seen in FIG. 5E. For this purpose, cam rollers 42*a* and 44*a* are carried respectively by pickup and grid heads 24, 22 which ride on cams 42 and 44, respectively. Pickup heads 24 and grid heads 22 slide on transfer arms 20 by means of guide bearings which carries support frame 12 on which pickup and grid heads 22 and 24 are pivotally and slidably carried. Cam rollers 42*a* and 44*a* are secured to the guide bearing carried by support frames 12. In this manner, the vertical positions of the pickup head 24 and grid head 22 are controlled as the cam rollers follow circular cams 42 and 44 to provide the desired operational positioning. In essence, a sequencing and control of the vertical positions of pickup heads 24 and grid heads 22 may be provided like that disclosed in the incorporated '249 patent or co-pending U.S. patent application Ser. No. 09/418,619 in regard to the picking up and releasing steps of operation.

As can best be seen in FIG. 5D, pickup heads 24 and grid heads 22 move in a closed cyclic path, designated as 60 as they are rotated by turret B. Along pick up station, the heads move over the articles fed in by article feeder C. For this purpose, the circular motion of the pickup and grid heads is compounded by pivoting the pickup heads about axis 68 converting their movement to a straight-line motion over this section so that the pickup heads reliably align with and pick up the articles over the pickup station 16. For this purpose, a motion converter, designated generally as F is best seen in FIGS. 5B and C, is provided for causing pickup heads 24 and grid heads 22 (or pickup heads 24 alone) to move in the straight-line motion through the pick up section 16 during the time the pickup heads descend and grip the articles for transfer to the release station. The pick up section 16 is measured over a pre-determined arc of rotation of turret B which, in the illustrated embodiment, is an arc of about 30 degrees of turret rotation. The 30 degrees includes 15 degrees either side of a radius line 66 perpendicular to a tangent at the pickup station.

Motion converter F, as can best be seen in FIGS. 5A–5D, will now be described in more detail. First, it is noted that pickup head frame 24*a*, which mounts the pickup fingers, is slidably carried in a horizontal frame on pickup head support frame 12 and functions about a swivel or pivotal axis 68. Grid head frame 22*a* is likewise slidably supported on a grid head support frame 12. Each support frame 12 includes a bottom ledge and an upper ledge between which a curved bearing member 44 of head frame 22*a*, 24*a* is sandwiched on both sides of the frame. Preferably curved bearing 44 is constructed of a suitable bearing material such as a high molecular weight plastic. By this means, the pickup and grid heads are allowed to slide in a combined swivel and translatory motion within their respective support frames. Thus, in operation, the pickup heads (and grid heads) rotate about turret axis Y as they are carried by turret B; and pivot about a swivel pivot axis 68 during circular motion. Motion converter F further includes a plurality of connector mechanisms, connected between the rotating turret and an associated set of pickup and grid heads to control movement of the pickup and grid heads so they move in a straight-line motion along pick up section 16. As can best be seen in FIG. 5B, connector mechanism F includes a first linkage arrangement 92 connected to one side of the pickup head and grid head; and a second linkage arrangement 94 connected to an opposing side of the pickup head and grid head. By this means, the heads are moved in unison. The linkage arrangements include rotary-motion transfer cam shafts 92*a*, 94*a* which are carried vertically between top and bottom turret plates 34 and 36. Upper arm links 92*b* and 94*b* are received about upper ends of the cam shafts and are secured thereto against rotation. In this manner, actuation of upper arm links 92*b*, 94*b* causes rotation of the cam shafts. First and second lower arm links 92*c*, 94*c*, and 92*d*, 94*d* are slidably carried on cam shaft 92 and 94, respectively. First lower arm links 92*c*, 94*c* are secured to opposing sides of pickup heads 24 and second lower arm links 92*d*, 94*d* are connected to grid heads 22. Cam followers 92*e* and 94*e* carried by the upper arm links 92*b*, 94*b* follow a cam plate which is affixed to the top of stationary column 40. The cam followers ride in a cam groove and follow the cam plate to actuate the first and second lower arm links to move the pickup heads and grid heads in a combination swivel and translatory motion to maintain the pickup and grid heads in a straight-line motion over the pick up section 16 for reliable pick up of articles 13.

The cam plate may be stationarily mounted on the central support. Basically, the heads are maintained in a straight-line motion over a linear distance that corresponds to a predetermined arc of about 30 degrees of turret rotation. Other means of providing the combination motion of the pickup and/or grid heads may also be used other than illustrated mechanism F. For example, use of position sensors and control through an electronic gear motor may be had, or hydraulic control systems, as well as other mechanical arrangements.

Referring now to FIGS. 1 and 5A. An unlatching device 14 is likewise carried by support frame 12, whose operation will not be described hereinafter. The unlatching drive is described in detail in earlier filed co-pending U.S. patent application Ser. No. 09/418,619.

In operation, at release station 18 the unlatching device actuates the gripping members of pickup head 24 to release articles 13 into cases 28.

Thus, it can be seen that a highly advantageous apparatus and method for a continuous case packing and depacking machine can be had according to the present invention wherein a small foot print, turret may be rotated continuously to pick up and release articles at a high speed while requiring only a small floor area. The transfer of articles occurs at high speeds yet the motion is balanced and smooth since it is basically circular. The dynamic forces produced by orbital machines having straight runs and radial ends is avoided. By converting the motion of the pickup heads from circular to translational when the articles are picked up, reliable pick up of the scrambled articles is provided for reliable insertion into a partitioned case. The case packing may occur over an arcuate section of the conveyor immediately after pick up by using congruent case and pick up head paths at increased speeds.

Figure 4:
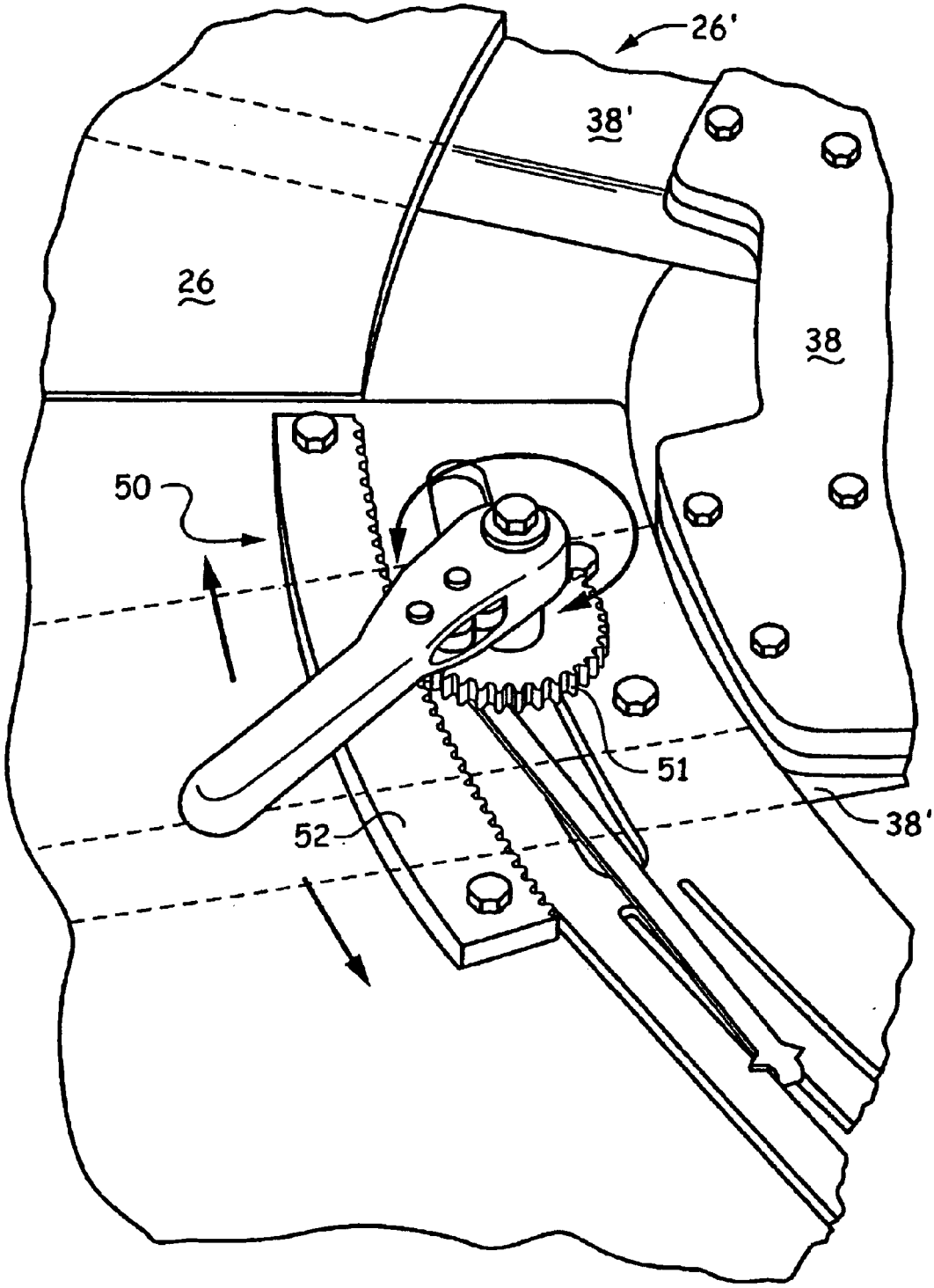
FIG. 4 is an exploded sectional view showing the plate adjusting apparatus.

Turning to FIGS. 3, 4 and 5E it can be seen secure with the rotating turret B and adjacent to lower frame member 36 there is provided a circular support frame 38. Support frame 38 is provided with a circumferential shelf in the form of radically extending fingers 38' which extend outwardly to substantially align with support frames 12.

Plate 26, is formed with a central opening 26' which is of a size to fit over column 10 and frame member 36. Plate 26 is positioned over column 10 to be freely supported by fingers 38' as best seen in FIGS. 4 and 5E.

An adjusting device 50, is provided for adjusting the circumferential position of plate 26, on shelf 38' relative to the fixed circumferential position of heads 22, 24. The adjusting device includes a ratchet wheel 51 which engages with teeth 52 secured with plate 26. Actuation of the handle member rotates wheel 51 which causes plate 26 to slide in a circumferential direction relative to column 10 and support frame 38.

This movement constitutes a circumferential adjustment of the position of heads 22, 24 relative to pins 27 of plate 26. This adjustment is necessary to accommodate a change in article and case sizes. Ratchet mechanism 46 also functions to maintain plate 26 and support frame 38 in fixed relative positions during operation of the packing device.

Turning to FIG. 3, case conveyor D, which may comprise an endless belt, operates to continuously urge cases 28 to dispensing section 30. Dispensing bar 32 is positioned across the path of the oncoming cases. A control, driven in sequence with the main drive, acts to sequentially pivot bar 32 downward which releases successive cases onto guide platform 33 and onto plate 26.

Arranged above and adjacent the outer and inner peripheries of plate 26 are guide rails 46 and 48. Inner guide rail 48 is pivoted at it forward end 49 and generally urged outwardly. This allows guide rail 48 always be in contact with a case 28 and to urge the cases against outré rail 46. Outer guide rail 46 is locked in position at one end with platform 33 and adjacent its opposite end is held by adjustable mount 47.

In the event of a change in article and case size guide rail 47 is adjusted inwardly, adjusting the radial position of the cases in the release or deposit station relative to heads 22, 24.

In operation, as a case is pushed from dispensing section 30 onto plate 26, a pin 26 engages with its rear end circumferentially locating the case relative to heads 22, 24. Further rotation of plate 26 moves the case into contact with guide rails 46, 48 which act to radially and longitudinally adjust the case relative to heads 22, 24. In this manner the case is controlled to be in proper position for the deposit of articles therein at the release station.

When an article size change is called for, heads 22, 24 are exchanged to accommodate the selected size, either smaller or larger. Pins 27 of plate 26 are then circumferentially adjusted by ratchet 46 and rail 46 is radially adjusted so that the new size case will be properly located relative to the re-sized heads in the release position.

Each case 28 includes a bottom, opposed sides, opposed ends and an open top. Front, rear and side flaps 28*a*, 28*b* are in a down position adjacent the case sides and are interconnected and held in this position by a pair of tabs 29 as best shown in FIGS. 1 and 6B–6D. Tabs 29 are located at opposed corners and insure that the flaps do not interfere with the operation of heads 22, 24 during the deposit of the articles into the cases as they pass through the release station.

The device thus far described operates in the following manner. Articles 13 are supplied to the pickup station 16 and grouped into a slug of articles. Empty cases are moved to the dispensing section 30 by conveyor D and are retained there by bar 32. Turret B rotates about axis Y carrying heads 22, 24 and plate 26 through pickup station 16, and release 18. The heads are carried on a rotary path and simultaneously with this rotary motion through a vertical motion and an oscillating motion.

As the guide and pickup heads move through the pickup station the pickup heads are controlled to pick up a slug of articles. In sequence with this action bar 32 releases a case onto plate 26 where it is positioned in alignment with heads 22, 24. As the heads move through the deposit or release position, the heads move vertically to deposit the articles into the case.

A separating assembly G for separating or cutting tabs 29 and for elevating the front and rear flaps is provided at opposed corners of heads 22, 24, see FIG. 5A. Each separator includes an arm 54 pivotally mounted with grid head 22 and urged toward an end of case 28 by spring 56. Attached to the lower end of each arm 54 is a positioning blade 58. The upper end of arm 54 carries cam 55.

Pickup head 24 carries a pair of downwardly depending arms 60 each formed to include a cam surface 61. Each arm 60 is stationarily located in a position aligned with arm 54.

Figure 6A:
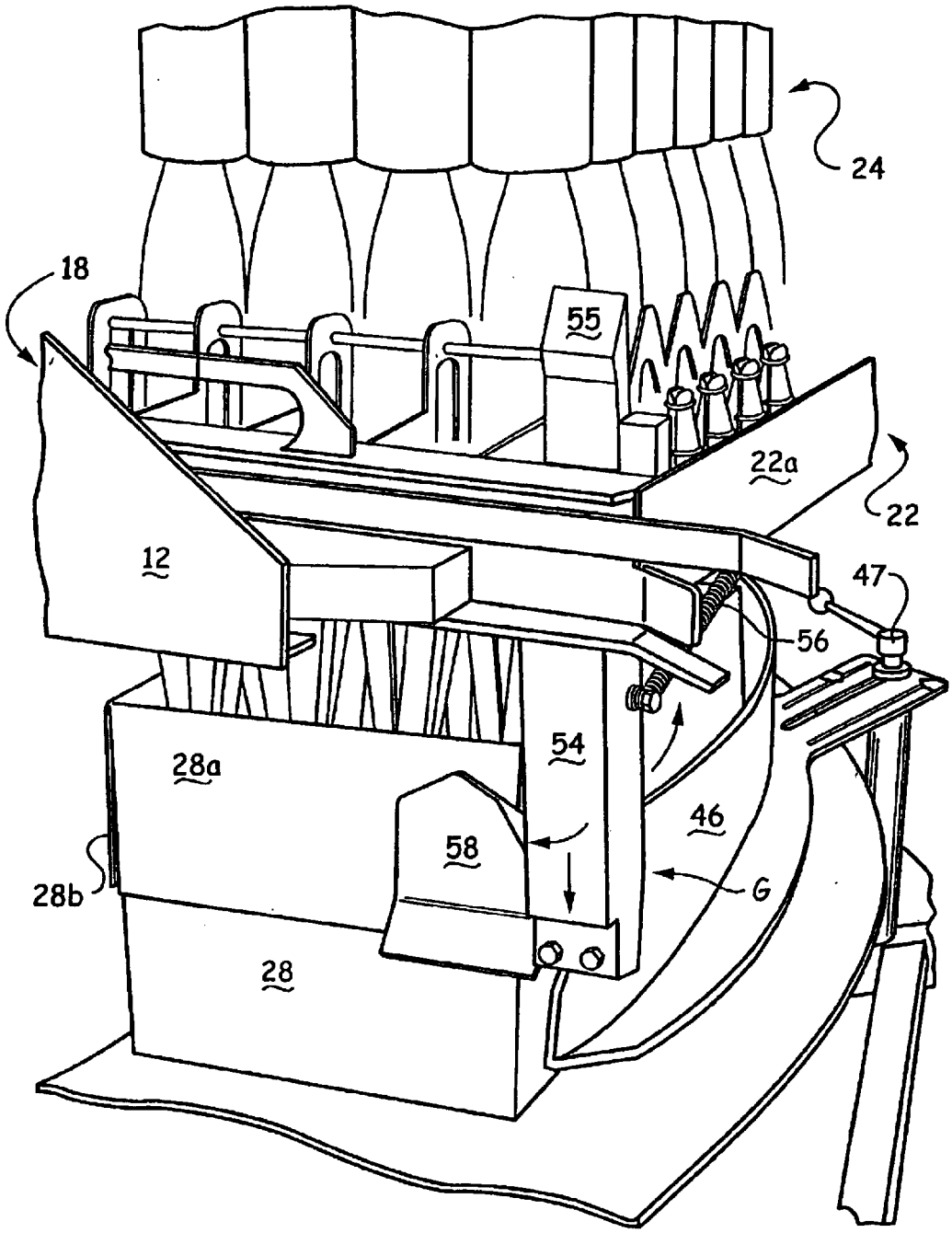
FIG. 6A is an exploded sectional perspective of the flap separator.
Figure 6B:
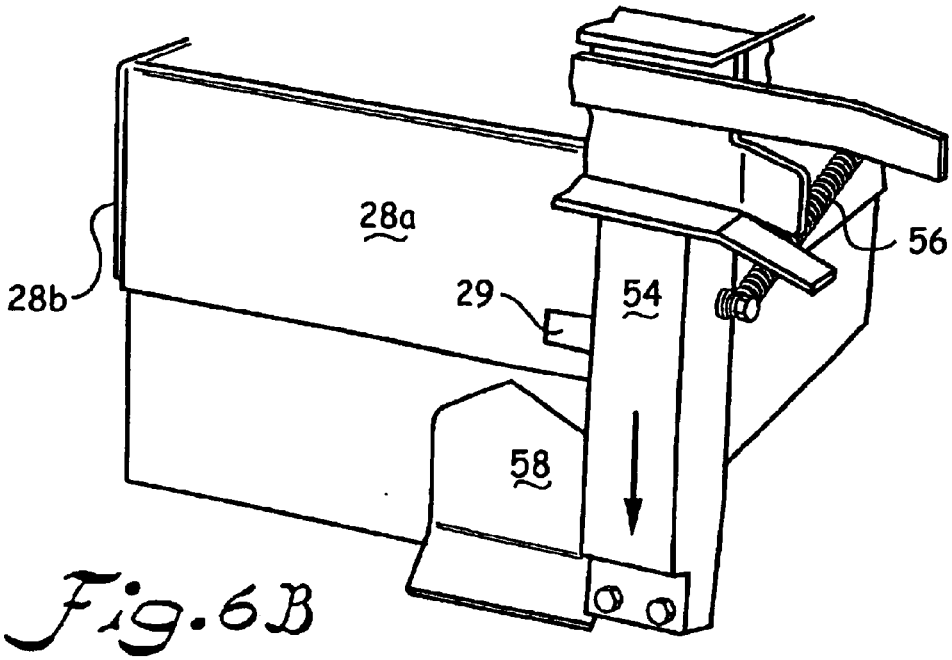
FIG. 6B is similar to FIG. 6A showing the separator in its lowermost position relative to the case.
Figure 6C:
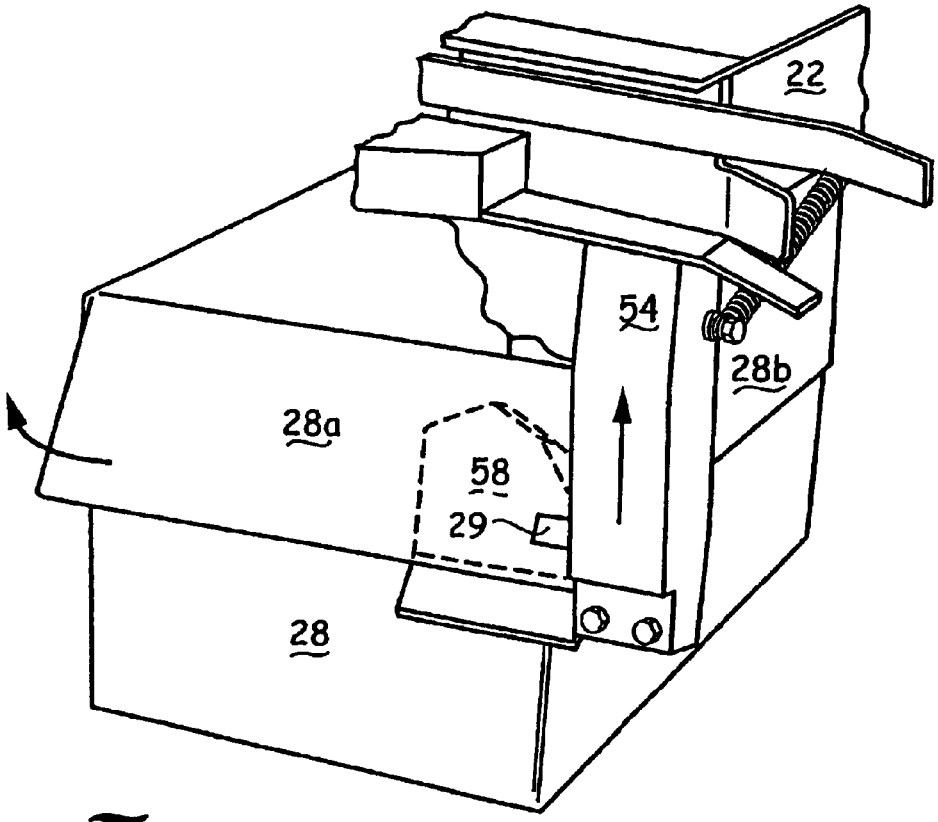
FIG. 6C is similar to FIG. 6A showing the separator in position behind the flap prior to separation.
Figure 6D:
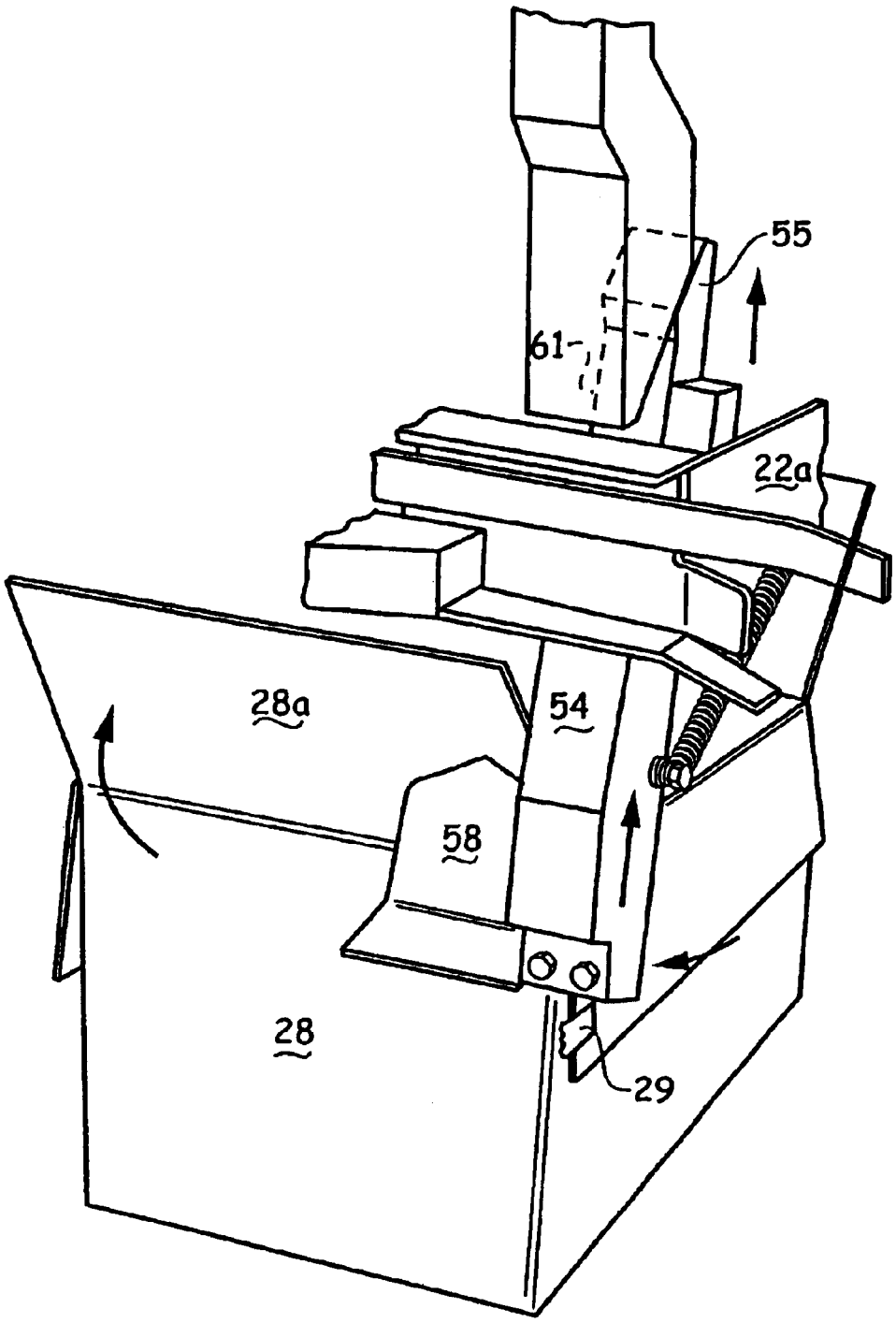
FIG. 6D is similar to FIG. 6A showing the separator raising the end flap after separation.

As shown in FIGS. 5A, 6B, C and D, as grid head 24 moves into its lowermost position in the release station, blade 58 slides down the outer end of case 28 into a position beneath flap 28*a*. Spring 56 maintains blade 58 in continued contact with the case end. After the articles are released into the case, grid head 22 begins its upward motion causing blade 58 to move up and beneath flap 28*a* which acts to sever tab 29 and release flaps 28*a* and 28*b* for pivotal movement. Further relative movement between grid head 22 and pickup head 24 brings cam 61 of arm 60 to engage with cam 55 causing arm 54 to pivot moving blade 58, which is now behind the associated flap 28*b*, away from the end of case 28 causing end flap 28*b* to be pivoted upward. See FIG. 6D.

It is understood that an identical action occurs simultaneously at each of the diagonally opposed corners of case 28.

Figure 7A:
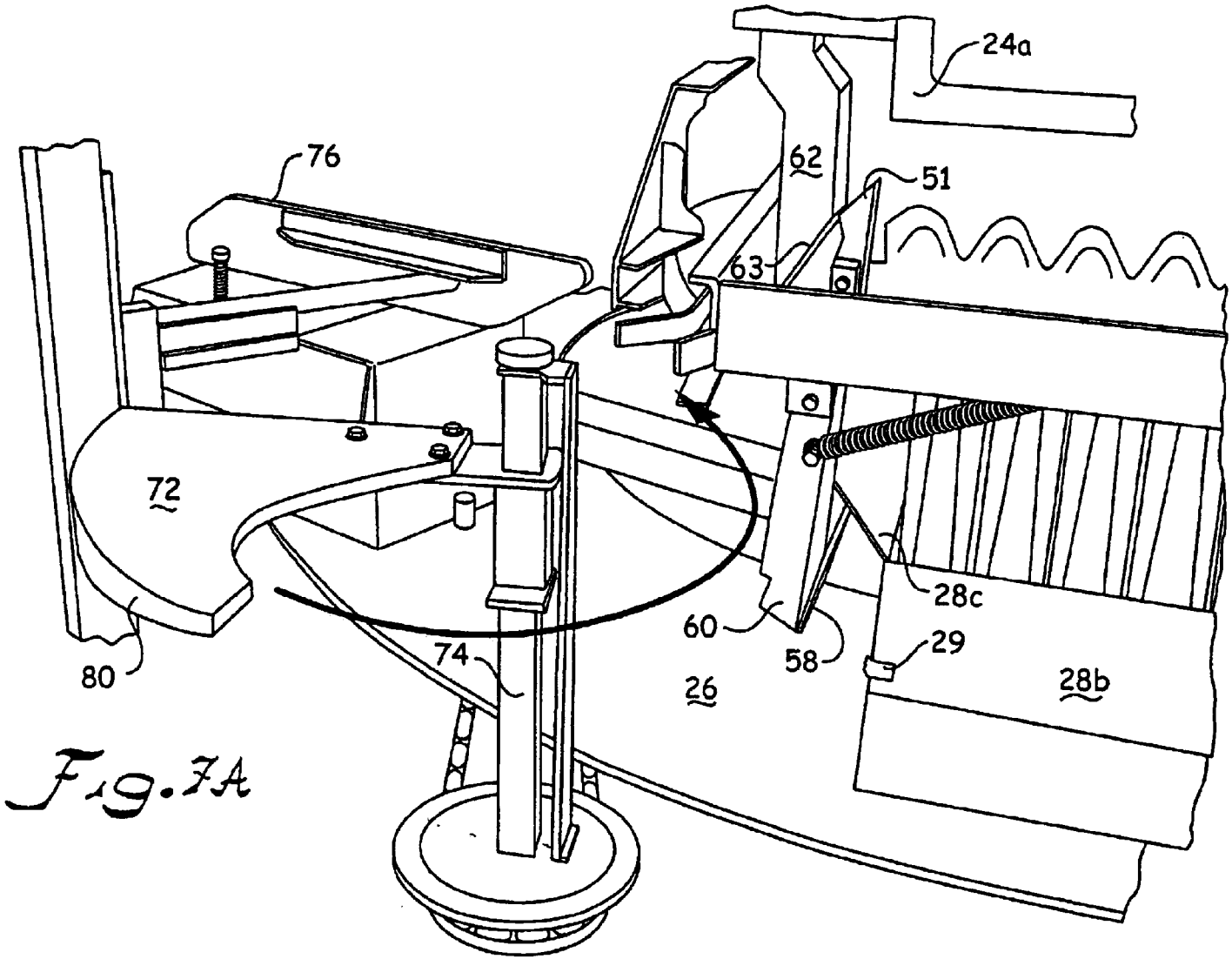
FIG. 7A is an exploded sectional perspective view showing the rear flap fold down positioning disk.
Figure 7B:
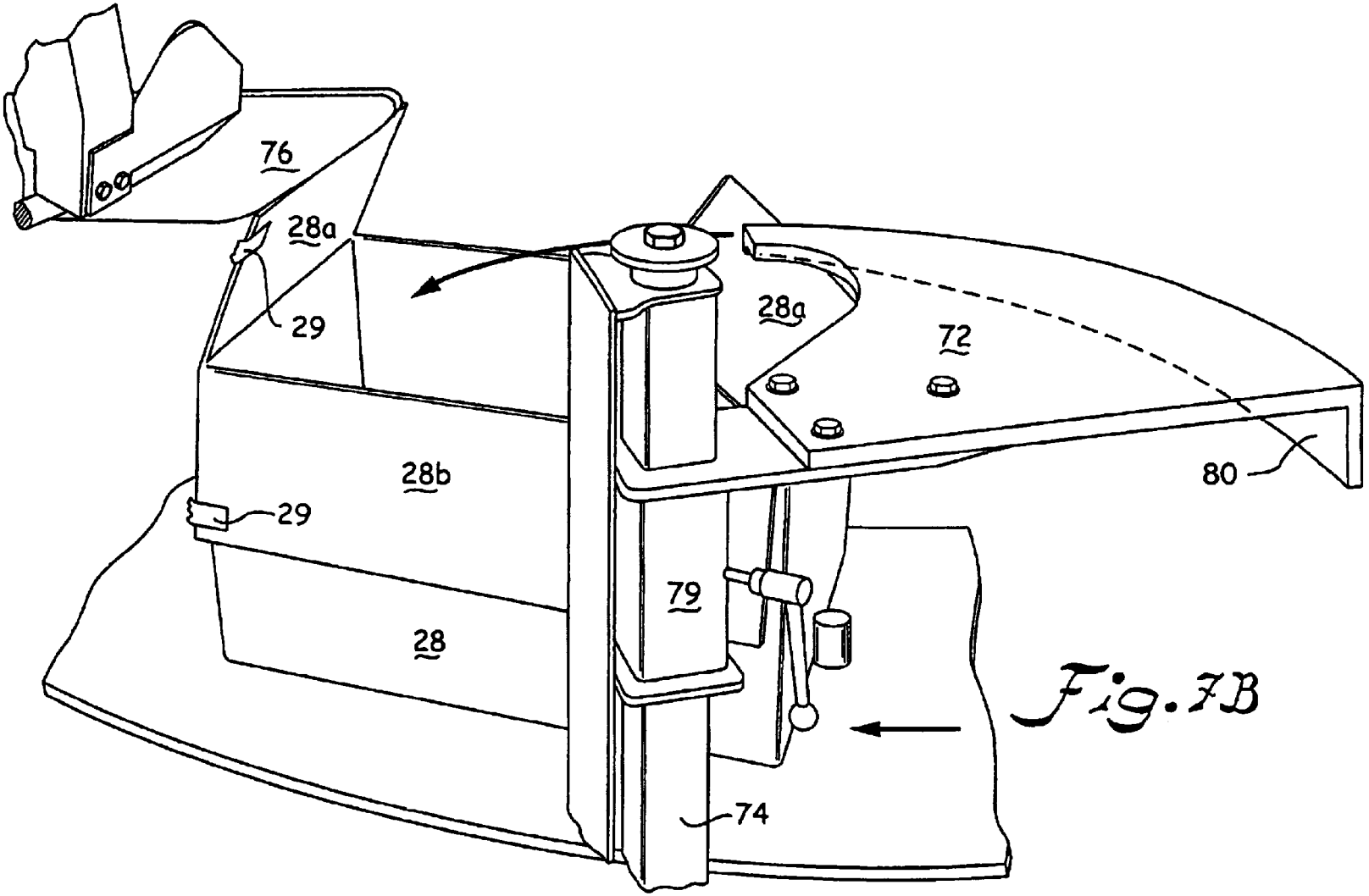
FIG. 7B is similar to FIG. 7A showing the positioning disk in engagement with the rear flap.

Turning now to FIGS. 3, 7A, 7B, take away or removal station 70 is provided to receive filled cases 28 with their front and rear flaps raised from the release station 18. The removal station includes a pair of end flap positioning members. A first of the positioning members comprises a rotating plate or disc 72 located adjacent the exit area of the release station. Plate or disc 72 is carried by shaft 74 which is rotated in timed sequence with turret B and plate 26. Disc 72 is vertically adjustable along shaft 74 to accommodate different size articles and cases.

Plate 72 includes a wedge-shaped outer edge 80 which, as shown in FIGS. 7A and 7B, increases in length from front to rear. Plate 72 is also substantially wedge-shaped with its periphery comprising about ⅛ of the circumferential arc along which outer edge 80 moves.

An adjustment assembly 79 secures plate 72 with shaft 74 in a desired vertical position.

In operation, case 28 moves from release or deposit station 18 into take away station 70 with its rear flap in the slightly raised position brought about by positioning blade 58. As the case moves into the takeaway station the rear flap 28*a* is engaged by the forward end of disc 72 and through rotation of the disc is moved to a substantially closed position by edge 80. Because disc 72 is moving faster than case 28 is moving, it passes over the case pushing the rear flap into the closed position while the case is being directed to the take away station 70.

Figure 8A:
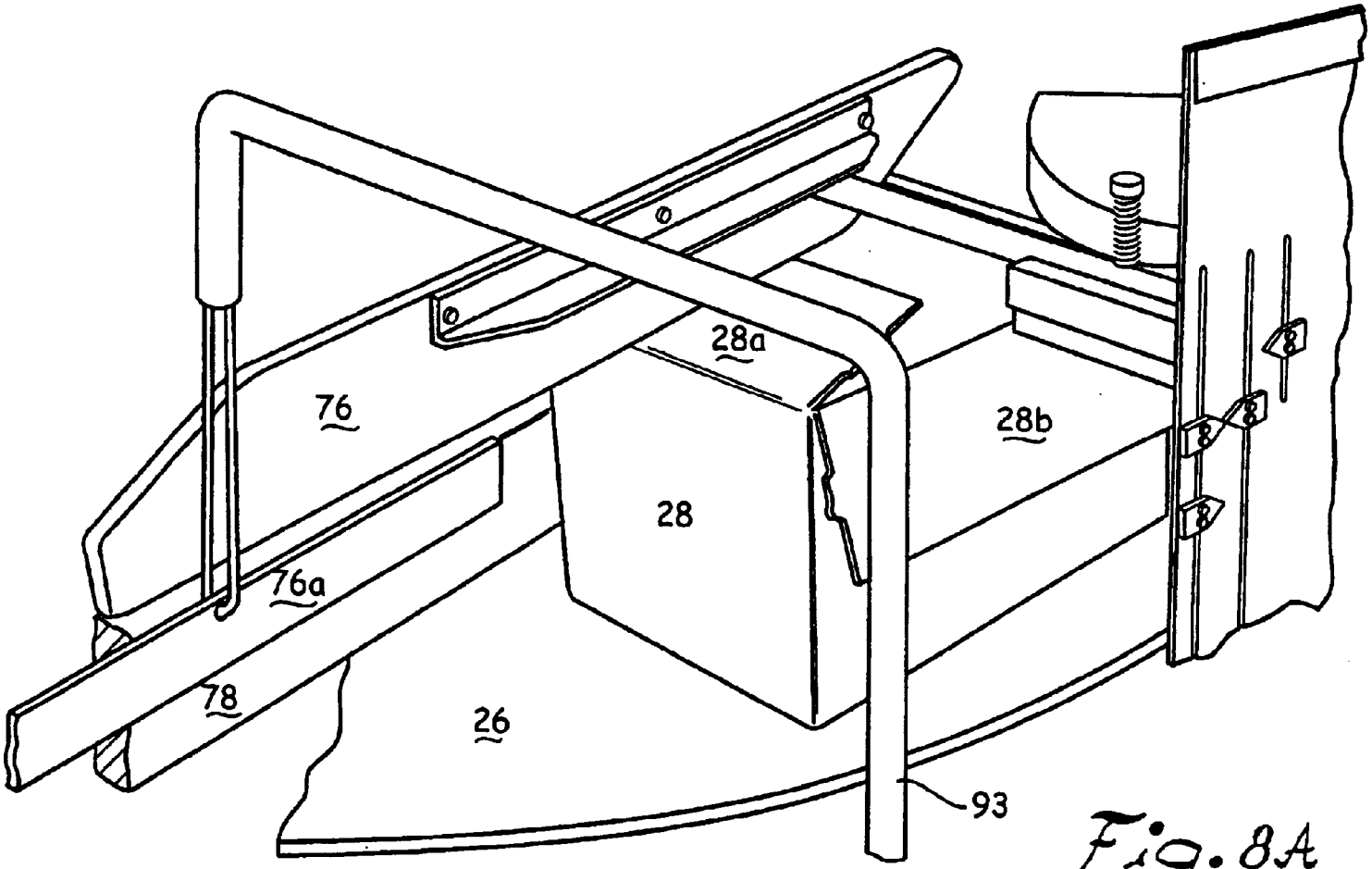
FIG. 8A is an exploded view of the entry of the sealing apparatus with the positioning rail folding down the raised front flap.
Figure 8B:
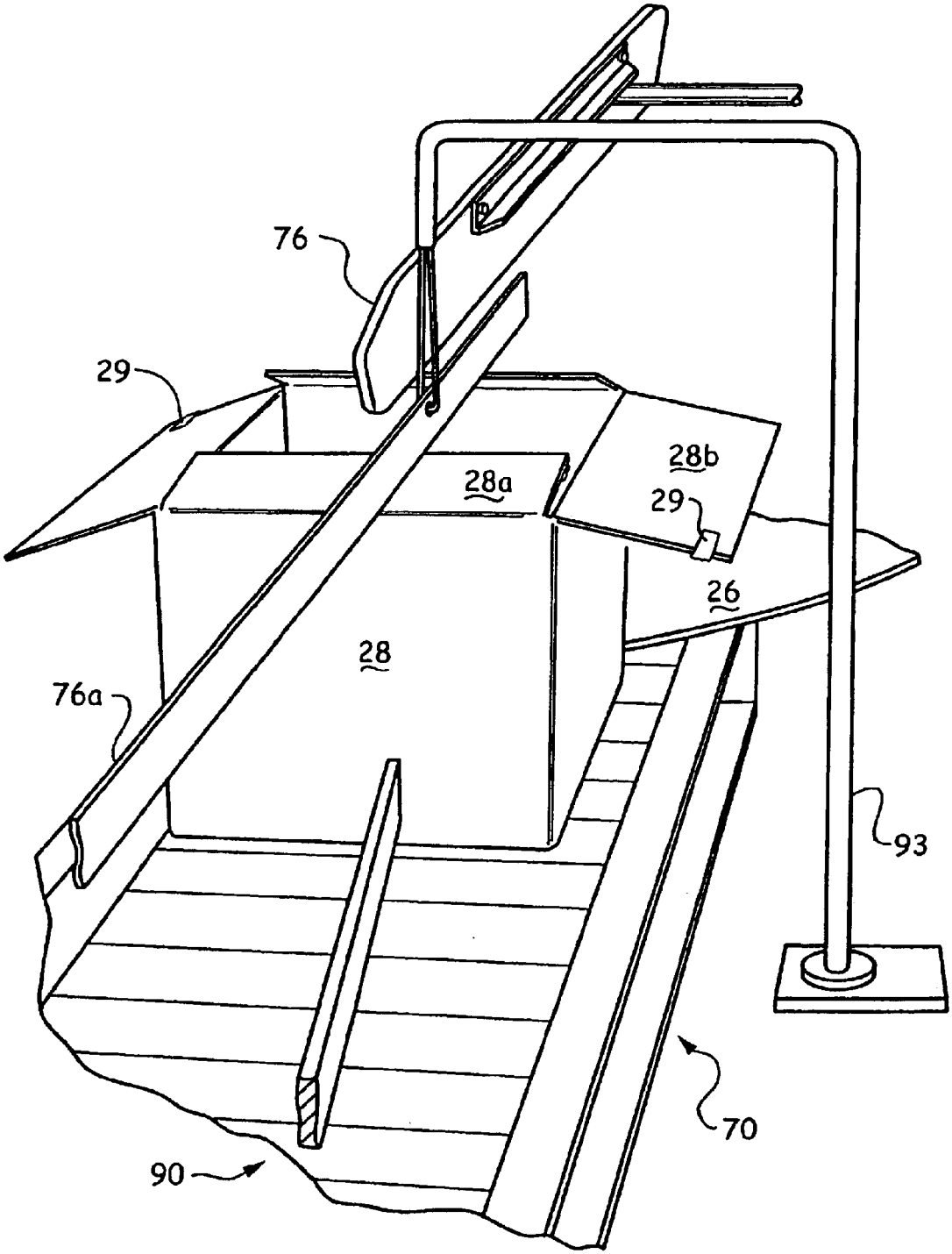
FIG. 8B is a progression of FIG. 8A showing the front and rear flaps being moved to and held in the closed position.
Figure 8C:
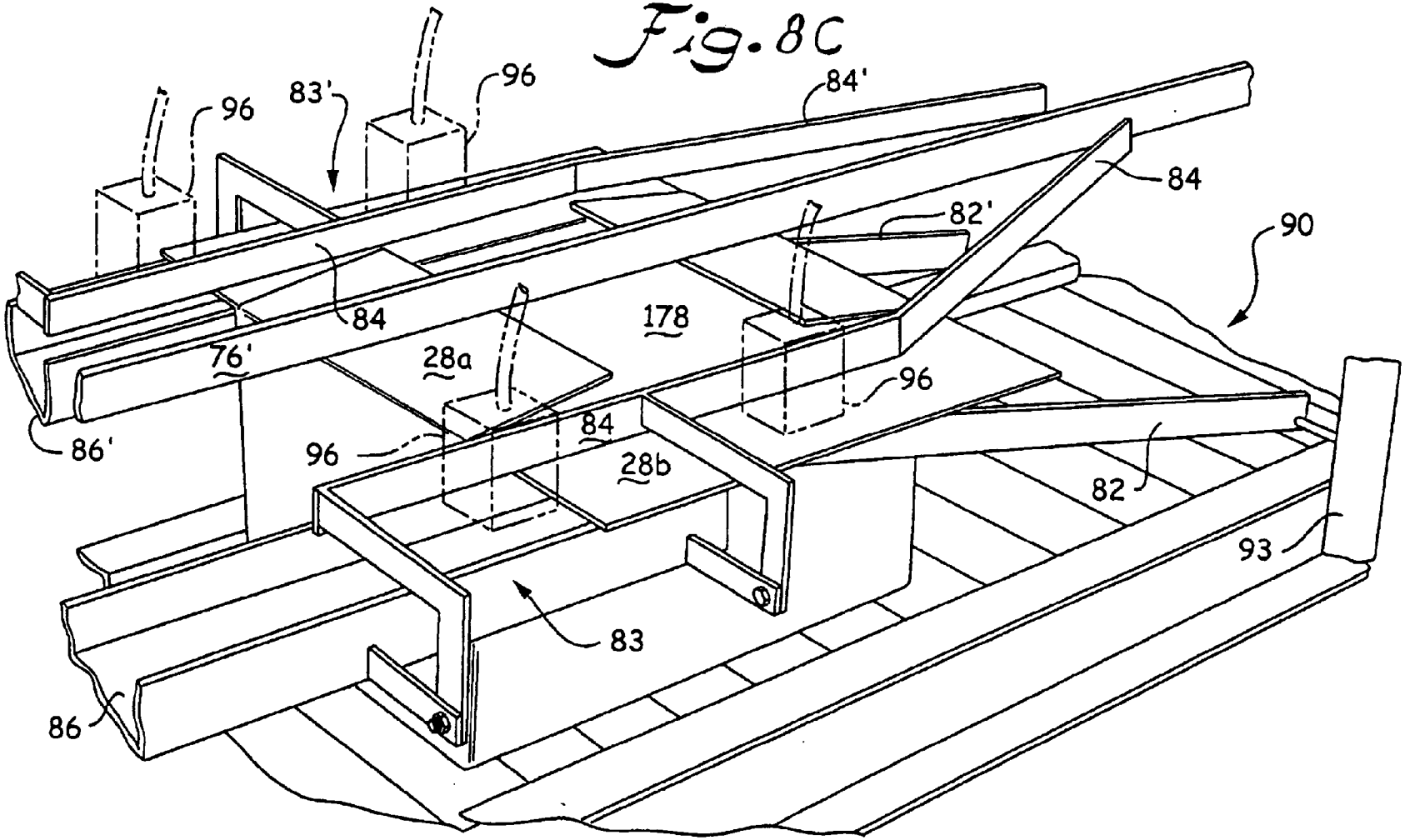
FIG. 8C is similar to FIG. 8 showing flap control arms and the adhesive applying members.

Simultaneously with this action the forward end of case 28 with the forward flap 28*b*, also slightly raised, moves under a second positioning member which comprises rail 76 which engages and folds down the forward flap. See FIGS. 7A, B and FIG. 8A. Further movement of case 28 positions folded down rear flap under rail 76.

Turning now to FIGS. 3, 8A–D, guide 78, is connected with frame 92 adjacent the receiving end of takeaway or removal conveyor 90 and extends across plate 26 at removal station 70. Guide 78, which is aligned with the inner rail 82' of takeaway conveyor 90, acts to deflect each case 28 onto the takeaway conveyor. During the time in which guide 78 is deflecting the case onto the conveyor, positioning rail 76, 76' is positioned to hold down front and rear flaps 28*b*.

As case 28 continues to be moved by conveyor 90 into sealing station 80 flaps 28*b* continue to be held down by positioning rail extension 76'.

Sealing station 80 includes a pair of guide and support rails arranged on each side of conveyor 90 and identified as 86, 86'. The guide and support rails included forward extensions which are attached at their forward ends with frame 93. Forward extensions 82, 82' are ramped upward to merge with the guide and support rails which extend along a run which is horizontal and substantially parallel with the height of case 28 and indicated at 83, 83'. Rail 82' begins in a position adjacent the end of guide 78 and extends parallel with the inner side of conveyor 90 up to horizontal run 83' while rail 82 extends an equal distance along the opposite side of conveyor 90.

The guide and support rails comprise a pair of parallel rails spaced about three inches apart or of a width sufficient to support side flaps 28*a* in a substantially fixed position. Other arrangements such as a flat sheet could be used along the horizontal run.

An upper guide assembly comprising an upper rails 84, 84' which are positioned slightly above guide and support rails 86, 86' act to position each side flap 28*b* onto the guide and support rails during movement of the case through horizontal run 83, 83'.

A plurality of adhesive applicators are located over the horizontal run 83 in position to apply adhesive onto side flaps 28*b* as case 28 is moved through horizontal run 83.

The sealing operation, thus far described, operates in the following manner. Guide 78 deflects filled case 28 onto conveyor 90 with front and rear flaps 28*b* held in the closed position by rail 76. As the case is moved away from plate 26 side flaps 28*b* are engaged by extensions 82, 82' of the guide and support rails and brought into a substantially horizontal position as the case is moved along horizontal run 83, 83'. Simultaneously upper guide rails 84, 84' engage with the upper sides of side flaps 28*b* to maintain them in a substantially fixed position during this movement through the horizontal run.

Substantially simultaneously with the positioning of the side flaps in the horizontal position, adhesive applicators 96 are actuated to apply adhesive onto the upwardly surface of side flaps 28*b*.

Immediately adjacent the downstream end of horizontal run 83, 83' there is provided a pair of inwardly and upwardly directed wedges 88. Wedges 88 are designed to engage beneath the outwardly extending side flaps as they leave horizontal runs 83, 83'and urge them upwardly into a substantially vertical position during continued movement of the case and best shown in FIG. 8D.

A pair of spring biased arms 95 are pivotally mounted on supports 94' carried by rails 86, 86'. Arms 95 are arranged to be resiliently urged into a downwardly and inwardly directed position.

Arranged adjacent and slightly over the downstream ends of arms 95 is the sealing apparatus which comprises a chain 96 carried by support arm 100 and frame 93 in a position over takeaway conveyor 90. Secured with the under side of chain 96 is a flexible pad 98.

Figure 8D:
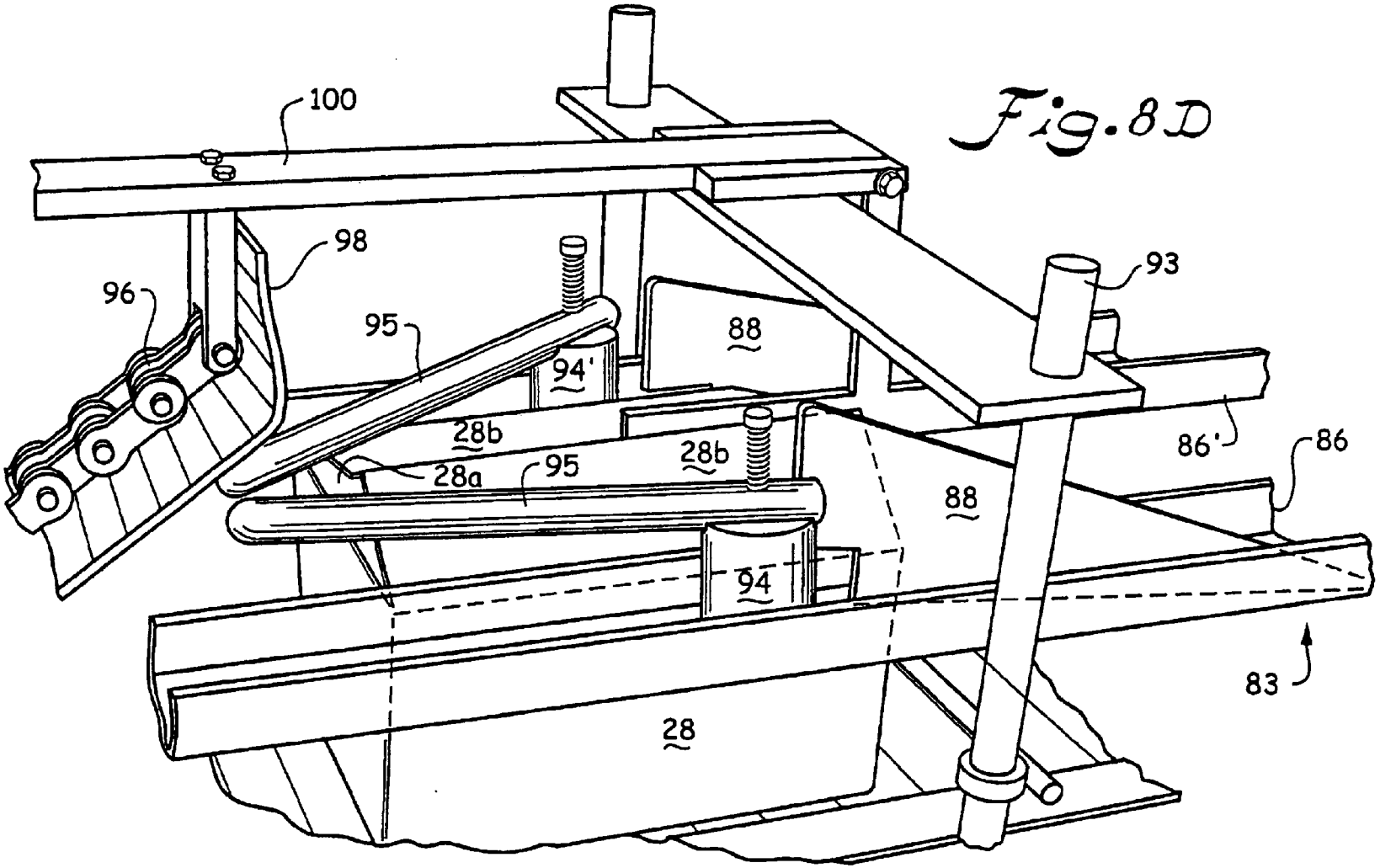
FIG. 8D is a progression of FIG. 8C showing the top flap closing structure.
Figure 8E:
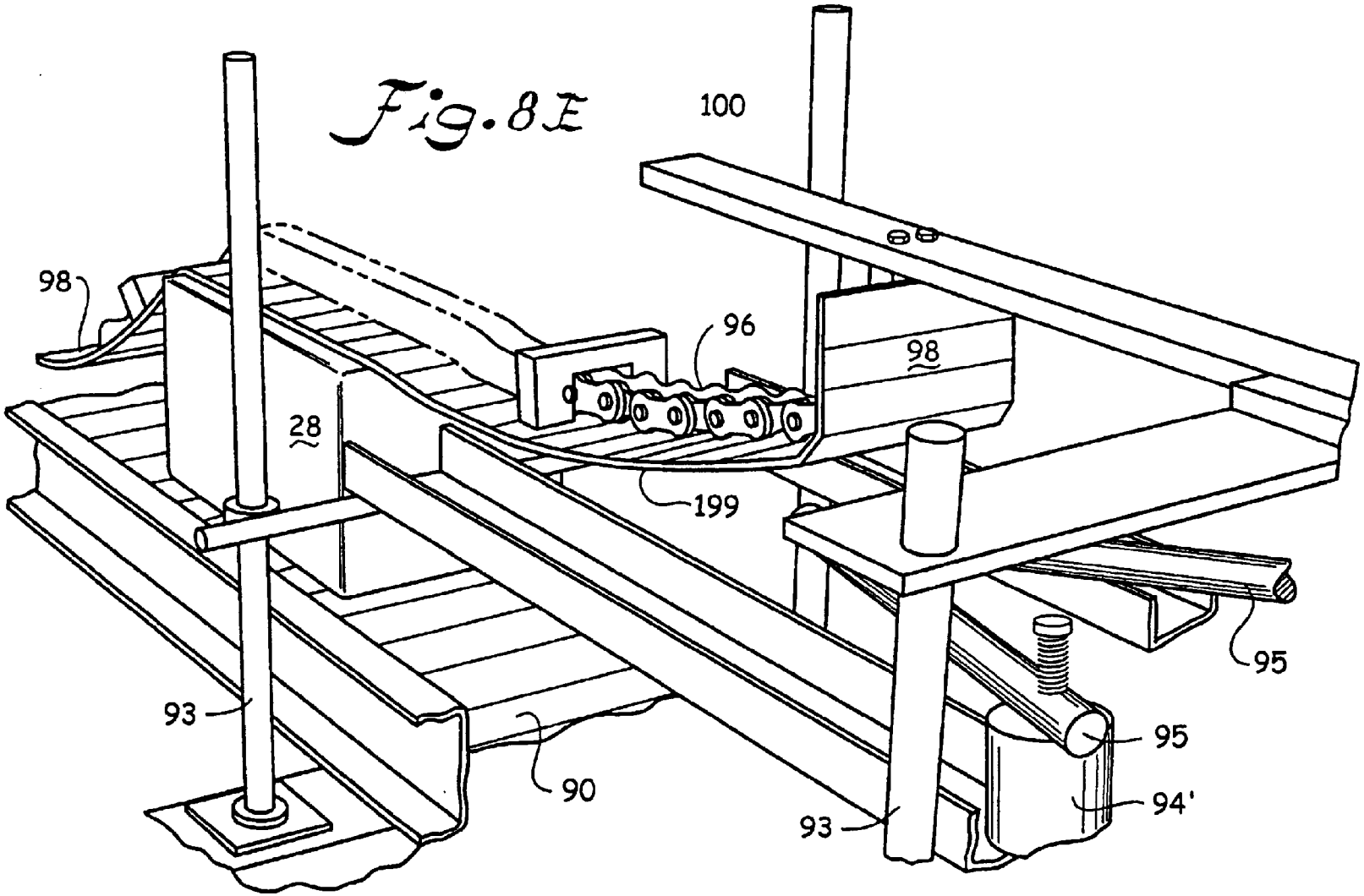
FIG. 8E is a progression to FIG. 8D showing the retaining structure for holding the closed flaps in position allowing the adhesive to set.

In operation case 28, with adhesive applied to opposed ends of flaps 28*b*, is moved from horizontal run 83 and over wedges 88. As the case advances, wedges 88 engage the under sides of flaps 28*b* and guide them upwardly into a substantially vertical position. At this point the case has advanced into position where depressing arms 95 adjacent supports 94' engage with the outer sides of the vertically positioned flaps. Continued movement of the case causes arms 95 to push on wedge flaps 28*b* into the closed position as best seen in FIG. 8D.

Immediately following the closing action brought about by arms 95, case 28 moves beneath pad 98 of the sealing apparatus. Due to the weight of chain 96, flaps 28*b* are firmly urged against end flaps 28*a* and held in this position during movement through the sealing apparatus. The duration of the movement beneath chain 96 is dependent upon the time required for the adhesive to set and seal the flaps in the closed position.

Sealed cases carried on conveyor 90 emerge from the sealing station 80 and are directed for further distribution While a preferred embodiment of the invention has been described using specific terms, such description is for illustrative purposes only, and it is to be understood that changes and variations may be made without departing from the spirit or scope of the following claims.

What is claimed is:

1. A packer apparatus for packing articles into open cases and closing the cases comprising:

a frame;

a rotating plate rotatably carried by said frame adapted to receive and transport successive cases, said cases having front, rear and side flaps maintained in a side folded position adjacent vertical sides of said cases to define an open case top, said plate moving said cases through a case deposit position and a case removal position;

pickup and grid heads carried by said frame and movable along vertical and radial paths, said pickup and grid heads being operative to move into a lower position to deposit slug of articles into said cases when passing through said case packing position; and flap separators operative at said case deposit position including blades for separating said flaps from one another and allow said front and rear flaps to be moved to an elevated position from said side folded position of said cases after said articles are deposited in said cases by said pickup and grid heads at said case deposit position; and said case removal position receiving said cases for delivery and further processing after packing and flap separation.

2. The packer apparatus of claim 1 including end flap positioning members carried by said frame, said flap positioning members being operative to fold said end flaps from said elevated position to a generally closed position wherein said end flaps overlie at least a portion of the open top of the cases as said cases are moved from said case deposit position and into said removal position.

3. The packer apparatus of claim 2 wherein said end flap positioning members include a positioning rail arranged adjacent said removal position said positioning rail acting to fold said front flap down.

4. The packer apparatus of claim 2 wherein said flap positioning members include a rotating positioning disk, said rotating positioning disk being operative to engage and fold down said rear flap as said case moves through said removal position.

5. The packer apparatus of claim 1 wherein each said flap separators are carried by said grid head;

a control mechanism carried by said pickup and grid heads, said control mechanism being operative to locate said flap separators in selective positions relative to said vertical case sides during movement of said pickup and grid heads wherein;

said flap separators act to first separate said flaps and secondly to elevate said front and rear flaps.

6. The packer apparatus of claim 5 wherein said flap separators are pivotally carried by said grid heads and said control mechanism includes a cam carried by said pickup head and a spring carried by said grid head.

7. A packing apparatus comprising:

a frame;

a conveyor adapted to carry successive cases through a case deposit position and a case removal position, each said case having connected front, rear and side flaps held against its vertical case sides defining open case tops;

a removal conveyor adapted to receive said cases from said removal position;

article pickup heads for gripping articles in sequence with said cases carried on said conveyor and being operative to deposit said articles in said cases when in said case deposit position;

flap separators for separating said flaps from one another and raising said separated flaps of said cases containing said articles; and, flap positioning members arranged adjacent said conveyor, said positioning members being operative to fold down said raised front and rear flaps over said case tops prior to said cases containing said articles moving through said removal position and onto said removal conveyor.

8. The packing apparatus of claim 7 wherein said flap positioning members include a rotating positioning disk which is operative to engage and fold down said raised rear flaps of said cases containing said articles existing said case deposit position.

9. The packing apparatus of claim 7 wherein said flap positioning members include a positioning rail positioned to engage and hold down said raised front flaps of said cases exiting said case deposit position.

10. The packing apparatus of claim 9 wherein said positioning rail extends from said case removal position over a sufficient portion of said removal conveyor to hold down said front and rear flaps over said case top when each said case is fully exited from said case removal position of said conveyor.

11. The packing apparatus of claim 7 including a case sealing apparatus arranged along said removal conveyor adjacent said case removal position.

12. The packing apparatus of claim 11 wherein said sealing apparatus includes guide and support rails arranged adjacent said removal conveyor, said guide and support rails having a support zone and a positioning zone, said guide and support rails being operative to locate said side flaps for receiving an adhesive in said support zone.

13. The packing apparatus of claim 12 wherein said sealing apparatus includes adhesive applicators operative to applying adhesive onto said side flaps supported by said guide and support rails in said support zone.

14. The packing apparatus of claim 12 wherein said guide and support rails are operative to elevate said side flaps in said positioning zone.

15. The packing apparatus of claim 14 wherein said case sealing apparatus includes side flap depressing arms which engage said elevated side flaps leaving said positioning zone and urge said side flaps into a closed position over said case tops.

16. The packing apparatus of claim 15 wherein said case sealing apparatus includes a press zone positioned over said removal conveyor adjacent said positioning zone, said sealing apparatus acting to press and hold said side flaps in position against said front and rear flaps until said adhesive secures said side, front and rear flaps in position.

17. The packing apparatus of claim 15 wherein said sealing apparatus comprises a flexible weight which includes an elongated weight having longitudinal flexibility.

18. A packing apparatus for packing articles into open cases, said open cases having major side flaps and minor end flaps, said side and end flaps being interconnected in a position wherein said flaps are flush against vertical sides of said cases to define an open case top, said apparatus comprising:

a frame;

a plurality of article pickup heads rotatably carried by said frame to rotate in a radial path for picking up said articles at a pickup position and depositing said articles at a case deposit position;

a rotary case conveyor rotating beneath said pickup heads adapted to sequentially receive and transport said open cases along a radial transport path generally corresponding to the radial path of said pickup heads, said radial transport path including the case deposit position, a flap separation position, and a case removal position;

said flap separation position including flap separators for severing the connection between said interconnected side and end flaps of said cases, and flap positioning members engaging said severed end flaps for positioning said end flaps in a generally closed position overlying said open case tops;

said case removal position receiving said packed cases after flap separation for delivery and further processing.

19. The apparatus of claim 18 including a removal conveyor adapted to successively receive the packed cases after passing through said case deposit and flap separation position; and case sealing apparatus associated with said removal conveyor, said case sealing apparatus being operative to apply an adhesive to at least certain of said flaps, and to move said side flaps over said end flaps and said case top into a secured closed position.

* * * * *